US010757524B2

(12) United States Patent
Grosche et al.

(10) Patent No.: US 10,757,524 B2
(45) Date of Patent: Aug. 25, 2020

(54) METHOD AND APPARATUS FOR ACOUSTIC SCENE PLAYBACK

(71) Applicant: Huawei Technologies Co., Ltd., Shenzhen (CN)

(72) Inventors: Peter Grosche, Munich (DE); Franz Zotter, Graz (AU); Christian Schörkhuber, Graz (AU); Matthias Frank, Graz (AU); Robert Höldrich, Graz (AU)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/393,602

(22) Filed: Apr. 24, 2019

(65) Prior Publication Data

US 2019/0253826 A1 Aug. 15, 2019

Related U.S. Application Data

(63) Continuation of application No. PCT/EP2016/075595, filed on Oct. 25, 2016.

(51) Int. Cl.
*H04S 7/00* (2006.01)
*G10L 19/008* (2013.01)
(Continued)

(52) U.S. Cl.
CPC ..... *H04S 7/303* (2013.01); *G10L 19/008* (2013.01); *H04R 1/403* (2013.01); *H04R 1/406* (2013.01);
(Continued)

(58) Field of Classification Search
CPC ..... G06F 3/165; G06F 16/683; G10L 19/167; H04S 2400/03; H04S 3/02; H04S 2420/03; H04S 2400/11
(Continued)

(56) References Cited

U.S. PATENT DOCUMENTS 7,394,904 B2 * 7/2008 Bruno ..... H04S 3/02 381/18
2010/0092014 A1 * 4/2010 Strauss ..... H04S 3/008 381/300

(Continued)

OTHER PUBLICATIONS

Spors et al., "Spatial Sound With Loudspeakers and Its Perception: A Review of the Current State," Proceedings of the IEEE, vol. 101, No. 9, XP011524153, pp. 1920-1938, Institute of Electrical and Electronics Engineers, New York, New York (Sep. 1, 2013).

(Continued)

*Primary Examiner* — Alexander Krzystan
(74) *Attorney, Agent, or Firm* — Leydig, Voit & Mayer, Ltd.

(57) ABSTRACT

A method for acoustic scene playback is described, which comprises: providing recording data comprising microphone signals of microphone setups positioned within an acoustic scene and microphone metadata of the microphone setups, each of the microphone setups has a recording spot which is a center position of the respective microphone setup; specifying a virtual listening position within the acoustic scene; assigning each microphone setup Virtual Loudspeaker Objects, VLOs, wherein each VLO is an abstract sound output object within a virtual free field; generating an encoded data stream based on the recording data, the virtual listening position and VLO parameters of the VLOs assigned to the microphone setups; and decoding the encoded data stream based on a playback setup, thereby generating a decoded data stream; and feeding the decoded data stream to a rendering device, thereby driving the rendering device to reproduce sound of the acoustic scene at the virtual listening position.

13 Claims, 17 Drawing Sheets

(51) Int. Cl.

| | |
|---|---|
| ***H04R 1/40*** | (2006.01) |
| ***H04R 3/00*** | (2006.01) |
| ***H04R 3/12*** | (2006.01) |
| ***H04R 5/02*** | (2006.01) |
| ***H04R 5/04*** | (2006.01) |
| ***H04S 3/00*** | (2006.01) |

(52) U.S. Cl.
CPC ..... *H04R 3/005* (2013.01); *H04R 3/12* (2013.01); *H04R 5/02* (2013.01); *H04R 5/04* (2013.01); *H04S 3/008* (2013.01); *H04S 7/30* (2013.01); *H04S 7/302* (2013.01); *H04R 2430/01* (2013.01); *H04S 7/304* (2013.01); *H04S 2400/01* (2013.01); *H04S 2400/15* (2013.01)

(58) Field of Classification Search
USPC ..... 381/22, 23; 700/94
See application file for complete search history.

(56) References Cited

U.S. PATENT DOCUMENTS

| | | | | |
|---|---|---|---|---|
| 2011/0002469 | A1 | 1/2011 | Ojala | |
| 2011/0261973 | A1* | 10/2011 | Nelson | H04S 3/00 381/92 |
| 2015/0230040 | A1 | 8/2015 | Squires et al. | |
| 2019/0253821 | A1* | 8/2019 | Buchner | H04R 3/005 |

OTHER PUBLICATIONS

Schroder et al., "RAVEN: A Real-Time Framework for the Auralization of Interactive Virtual Environments," European Acoustics Association, Forum Acusticum, pp. 1541-1546 (2011).

* cited by examiner

METHOD AND APPARATUS FOR ACOUSTIC SCENE PLAYBACK

CROSS-REFERENCE TO RELATED APPLICATIONS

This application is a continuation of International Application No. PCT/EP2016/075595, filed on Oct. 25, 2016, the disclosure of which is hereby incorporated by reference in its entirety.

TECHNICAL FIELD

The present disclosure is directed to a method for acoustic scene playback and an apparatus for acoustic scene playback.

BACKGROUND

In classical recording technologies, a surround image of spatial audio scenes, also called acoustic scenes or sound scenes, is captured and reproduced at a single listener's perspective in an original sound scene. Single-perspective recordings are typically achieved by stereophonic (channel-based) recording and reproduction technologies or Ambisonic recording and reproduction technologies (scene-based). The emerging possibilities of interactive audio displays and the generalization of audio transmission media away from cassettes or CDs to more flexible media allows for a more dynamic usage of audio, e.g. interactive client-side audio rendering of multi-channel data, or server side rendering and transmission of individually pre-rendered audio streams for clients. While already common in gaming, the before mentioned technologies are seldomly used for the reproduction of recorded audio scenes.

So far, traversing a sound scene in reproduction has been implemented only by audio rendering based on individually isolated recordings of the involved sounds and additional recordings or rendering of reverberation (object-based). By changing the arrangement of the recorded sources, the playback perspective at the reproduction side could be adapted.

Furthermore, another possibility is to extrapolate a parallax adjustment to a create an impression of perspective change from one single perspective recording by re-mapping a directional audio coding. This is done by assuming that source positions are obtained after projecting their directions onto a convex hull. This arrangement relies on time variant signal filtering using the spectral disjointness assumption for direct/early sounds. However, this can cause signal degradation. Furthermore, the assumption that sources are positioned on a convex hull will only work for small position changes.

Therefore, the prior art suffers from the limitations that when an object-based audio rendering is used to render a walkthrough, an explicit knowledge of the room properties, source locations and properties of the sources itself is required. Furthermore, obtaining an object based representation from a real scene is a difficult task and requires either many microphones close to all desired sources, or source separation techniques to extract the individual sources from a mix. As a result, object-based solutions are only practical for synthetic scenes, but cannot be used for achieving a high quality walkthrough in real acoustic scenes.

The present disclosure allows to solve the deficiencies of the prior art and allows for continuously varying a virtual listening position for audio playback within a real, recorded acoustic scene during playback of sound of the acoustic scene at the virtual listening position. Therefore, the present disclosure allows to solve the problem of having an improved method and apparatus for acoustic scene playback. Advantageous implementation forms of the present disclosure are provided in the respective dependent claims.

SUMMARY OF THE DISCLOSURE

In a first aspect, a method for acoustic scene playback is provided, wherein the method comprises:

providing recording data comprising microphone signals of one or more microphone setups positioned within an acoustic scene and microphone metadata of the one or more microphone setups, wherein each of the one or more microphone setups comprises one or more microphones and has a recording spot which is a center position of the respective microphone setup;

specifying a virtual listening position, wherein the virtual listening position is a position within the acoustic scene;

assigning each microphone setup of the one or more microphone setups one or more Virtual Loudspeaker Objects, VLOs, wherein each VLO is an abstract sound output object within a virtual free field;

generating an encoded data stream based on the recording data, the virtual listening position and VLO parameters of the VLOs assigned to the one or more microphone setups;

decoding the encoded data stream based on a playback setup, thereby generating a decoded data stream; and feeding the decoded data stream to a rendering device, thereby driving the loudspeaker device to reproduce sound of the acoustic scene at the virtual listening position.

The virtual free field is an abstract (i.e. virtual) sound field that consists of direct sound without reverberant sound. Virtual means modelled or represented on a machine, e.g., on a computer, or on a system of interacting computers. The acoustic scene is a spatial region together with the sound in that spatial region and may be alternatively referred to as a sound field or spatial audio scene instead of acoustic scene. Further, the rendering device can be one or more loudspeakers and/or one or more headphones. Therefore, a listener listening to the reproduced sound of the acoustic scene of the virtual listening position is enabled to change the desired virtual listening position and virtually traverse the acoustic scene. In this way, the listener is enabled to newly experience or re-experience an entire acoustic venue, for example, a concert. The user can walk through the entire acoustic scene and listen from any point in the scene. The user can thus explore the entire acoustic scene in an interactive manner by determining and inputting a desired position within the acoustic scene and can then listen to the sound of the acoustic scene at the selected position. For example, in a concert, the user can choose to listen from the back, within the crowd, right in front of the stage or even on the stage surrounded by the musicians. Furthermore, applications in virtual reality (VR) to extend from a rotation to also enable translation are conceivable. In embodiments of the present disclosure only the recording positions and the virtual listening positions have to be known. Therefore, in the present disclosure no information concerning the acoustic sources (for example the musicians), such as their number, positions or orientations is required. In particular, due to the usage of the virtual loudspeaker objects, VLOs, the spatial distribution of sound sources is inherently encoded without the need to estimate the actual position. Further, the room properties, such as reverberations are also inherently encoded and driving signals for driving the VLOs are used that do not correspond to source signals, thus eliminating the need to record or estimate the actual source signals. The driving signals are derived from the microphone signals by data independent linear processing. Further, embodiments of the present disclosure are computationally efficient and allow for both, real-time encoding and rendering. Hence, the listener is enabled to interactively change the desired virtual listening position and virtually traverse the (recorded) acoustic scene (e.g. a concert). Due to the computational efficiency of the disclosure the acoustic scene can be streamed to a far-end, for example, the playback apparatus, in real time. The present disclosure does not rely on prior information about the number or position of sound sources. Similar to classical single-perspective stereophonic or surround recording techniques all source parameters can be inherently encoded and need not to be estimated. Contrary to object-based audio approaches, source signals need not be isolated, thus avoiding the need for close microphones and audible artefacts due to source signal separation.

Virtual Loudspeaker Objects (VLOs) can be implemented on a computer; for example, as objects in an object-based spatial audio layer. Each VLO can represent a mixture of sources, early reflections, and diffuse sound. In this context, a source is a localized acoustic source such as an individual person speaking or singing, or a musical instrument, or a physical loudspeaker. Generally, a union of several (i.e. two or more) VLOs will be required to reproduce an acoustic scene.

In a first implementation form of the method according to the first aspect, after the assigning each microphone setup one or more VLOs, for each microphone setup, positioning the one or more VLOs within the virtual sound field at a position corresponding to the recording spot of the respective microphone setup within the acoustic scene.

This contributes for virtually setting up a virtual reproduction system consisting of the VLOs for each recording spot in one common virtual free field. Therefore, these features of the first implementation form contribute for arriving at an arrangement in which a user can vary the virtual listening position for audio playback within a real recorded acoustic scene during playback of the signal corresponding to the chosen virtual listening position.

In a second implementation form of the method according to the first aspect, the VLO parameters comprise one or more static VLO parameters which are independent of the virtual listening position and describe properties, which are fixed for the acoustic scene playback, of the one or more VLOs.

Therefore, the VLO parameters of the VLOs within the virtual free field describe properties of the VLOs, which are fixed for a specific playback setup arrangement, which contributes for adequately setting up a reproduction system in the virtual free field and describing the properties of the VLOs within the virtual free field. The playback setup arrangement for example refers to the properties of the playback apparatus itself, like for example, if playback is done by using loudspeakers provided within a room or headphones.

In a third implementation form of the method according to the first aspect, the method further comprises, before generating the encoded data stream, computing the one or more static VLO parameters based on the microphone metadata and/or a critical distance, wherein the critical distance is a distance at which a sound pressure level of the direct sound and a sound pressure level of the reverberant sound are equal for a directional source or, before generating the encoded data stream, receiving the one or more static VLO parameters from a transmission apparatus.

The static VLO parameters can thus be calculated within the playback apparatus or can be received from elsewhere, e.g., from a transmission apparatus. Furthermore, since the static VLO parameters take into account the microphone metadata and/or the critical distance, the static VLO parameters take into account parameters at the time point when the acoustic scene was recorded, so that as realistic as possible a certain sound corresponding to a certain virtual listening position can be played back by the playback apparatus.

In a fourth implementation form of the method according to the first aspect, the one or more static VLO parameters include for each of the one or more microphone setups: a number of VLOs, and/or a distance of each VLO to the recording spot of the respective microphone setup, and/or an angular layout of the one or more VLOs that have been assigned to the respective microphone setup (e.g, with respect to an orientation of the one or more microphones of the respective microphone setup), and/or a mixing matrix $B_i$ which defines a mixing of the microphone signals of the respective microphone setup.

Accordingly, these static VLO parameters are parameters which are fixed for a certain acoustic scene playback and do not change during playback of the acoustic scene and which do not depend on the chosen virtual listening position.

In a fifth implementation form of the method according to the first aspect, the VLO parameters comprise one or more dynamic VLO parameters which depend on the virtual listening position and the method comprises, before generating the encoded stream, computing the one or more dynamic VLO parameters based on the virtual listening position, or receiving the one or more dynamic VLO parameters from a transmission apparatus.

Thus not only the static VLO parameters, but also the dynamic VLO parameters can be easily generated within the playback apparatus or can be received from a separate (e.g., distant) transmission apparatus. Furthermore, the dynamic VLO parameters depend on the chosen virtual listening position, so that the sound played back will depend on the chosen virtual listening position via the dynamic VLO parameters.

In a sixth implementation form of the method according to the first aspect the one or more dynamic VLO parameters include for each of the one or more microphone setups: one or more VLO gains, wherein each VLO gain is a gain of a control signal of a corresponding VLO, and/or one or more VLO delays, wherein each VLO delay is a time delay of an acoustic wave propagating from the corresponding VLO to the virtual listening position, and/or one or more VLO incident angles, wherein each VLO incident angle is an angle between a line connecting the recording spot and the corresponding VLO and a line connecting the corresponding VLO and the virtual listening position, and/or one or more parameters indicating a radiation directivity of the corresponding VLO.

By the provision of the VLO gains a proximity regularization can be performed by regulating the gain dependent on the distance between the corresponding VLO corresponding to the VLO gain and the virtual listening position. Further, a direction dependency can be ensured, since the VLO gain can be dependent on the virtual listening position relative to the position of the VLO within the virtual free field. Therefore, a much more realistic sound impression can be delivered to the listener. Further, the VLO delays, VLO incident angles and parameters indicating the radiation directivity also contribute for arriving at a realistic sound impression.

In a seventh implementation form of the method according to the first aspect, the method further comprises, before generating the encoded data stream, computing an interactive VLO format comprising for each recording spot and for each VLO assigned to the recording spot a resulting signal $\tilde{x}_{ij}(t)$ and an incident angle with $\varphi_{ij}$ with $\tilde{x}_{ij}(t)=g_{ij}x_{ij}(t-\tau_{ij})$, wherein $g_{ij}$ is a gain factor of a control signal $x_{ij}$ of a j-th VLO of a i-the recording spot, $\tau_{ij}$ is a time delay of an acoustic wave propagating from the j-th VLO of the i-th recording spot to the virtual listening position, and t indicates time, wherein the incident angle $\varphi_{ij}$ is an angle between a line connecting the i-th recording spot and the j-th VLO of the i-th recording spot and a line connecting the j-th VLO of the i-th recording spot and the virtual listening position. Therefore, a certain interactive VLO format can be effectively used as input for the encoding, so that this interactive VLO format helps for effectively performing encoding.

In an eighth implementation form of the method according to the first aspect the gain factor $g_{ij}$ depends on the incident angle $\varphi_{ij}$ and a distance $d_{ij}$ between the j-th VLO of the i-th recording spot and the virtual listening position.

Therefore, proximity regularization is possible in case the virtual listening position is close to a corresponding VLO, wherein furthermore, the direction dependency can be ensured, so that the gain factor acknowledges both the proximity regularization and the direction dependency.

In a ninth implementation form of the method according to the first aspect, for generating the encoded data stream, each resulting signal $\tilde{x}_{ij}(t)$ and incident angle $\varphi_{ij}$ is input to an encoder, in particular an ambisonic encoder.

Therefore, a prior art ambisonic encoder can be used, wherein specific signals are fed into the amibsonic encoder for encoding, namely each resulting signal $\tilde{x}_{ij}(t)$ and incident angle $\varphi_{ij}$ for arriving at the above mentioned effects with respect to the first aspect. Therefore, the present disclosure according to the first aspect or any implementation form also provides for a very simple and cheap arrangement in which prior art ambisonic encoders can be used for enabling the present disclosure.

In a tenth implementation form of the method according to the first aspect, for each of the one or more microphone setups, the one or more VLOs assigned to the respective microphone setup are provided on a circular line having the recording spot of the respective microphone setup as a center of the circular line within the virtual free field, and a radius $R_i$ of the circular line depends on a directivity order of the microphone setup, a reverberation of the acoustic scene and an average distance $d_i$ between the recording spot of the respective microphone setup and recording spots of neighboring microphone setups.

The VLOs can thus be effectively arranged within the virtual free field, which provides a very simple arrangement for obtaining the effects of the present disclosure.

In an eleventh implementation form of the method according to the first aspect a number of VLOs on the circular line and/or an angular location of each VLO on the circular line, and/or a directivity of the acoustic radiation of each VLO on the circular line depends on a microphone directivity order of the respective microphone setup and/or on a recording concept of the respective microphone setup and/or on the radius $R_i$ of the recording spot of the i-th microphone setup and/or a distance $d_{ij}$ between a j-th VLO of the i-th microphone setup and the virtual listening position.

These features contribute to generating a realistic sound impression for the listener and contribute to all advantages already mentioned above with respect to the first aspect.

In a twelfth implementation form of the method according to the first aspect, for providing the recording data, the recording data are received from outside (i.e. from outside the apparatus in which the VLOs are implemented), in particular by applying streaming.

This enables that the recording data do not have to be generated within any playback apparatus but can simply be received from, for example, a certain corresponding transmission apparatus, wherein for example the transmission apparatus is recording a certain acoustic scene, for example, a concert and supplies in a live stream the recorded data to the playback apparatus. Subsequently, the playback apparatus can then perform the herewith provided method for acoustic scene playback. Therefore, in the present disclosure a live stream of the acoustic scene, for example, a concert, can be enabled. The VLO parameters in the present disclosure can be adjusted in real time dependent on the chosen virtual listening position. Therefore, the present disclosure is computationally efficient and allows for both, real time encoding and rendering. Hence, the listener is enabled to interactively change the desire to virtual listening position and virtually traverse the recorded acoustic scene. Due to the computational efficiency of the present disclosure an acoustic scene can be streamed to the playback apparatus in real time.

In a thirteenth implementation form of the method according to the first aspect, for providing the recording data, the recording data are fetched from a recording medium, in particular from a CD-ROM.

This is a further possibility for providing the recording data to the playback apparatus, namely by inserting a CD-ROM into the playback apparatus, wherein the recording data are fetched from this CD-ROM and therefore provided for the acoustic scene playback.

According to a second aspect a playback apparatus or a computer program or both are provided. The playback apparatus is configured to perform a method according to the first aspect (in particular, according to any of its implementation forms). The computer program may be provided on a data carrier and can instruct the playback apparatus to perform a method according to the first aspect (in particular, according to any of its implementation forms) when the computer program is run on a computer.

Generally, it has to be noted that all arrangements, devices, elements, units and means and so forth, described in the present application, could be implemented by software or hardware elements or any kind of combination thereof. All steps which are performed by the various entities described in the present application as well as the functionality described to be performed by the various entities are intended to mean that the respective entity is adapted or configured to perform the respective steps and functionalities. Even if in the following description of specific embodiments a specific functionality or step to be performed by a general entity is not reflected in the description of a specific detailed element of that entity, which performs that specific step or functionality, it should be clear for a skilled person that these elements can be implemented in respective hardware or software elements or any kind of combination thereof. Further, the method of the present disclosure and its various steps are embodied in the functionalities of the various described apparatus elements.

DETAILED DESCRIPTION OF DRAWINGS

Figure 1:
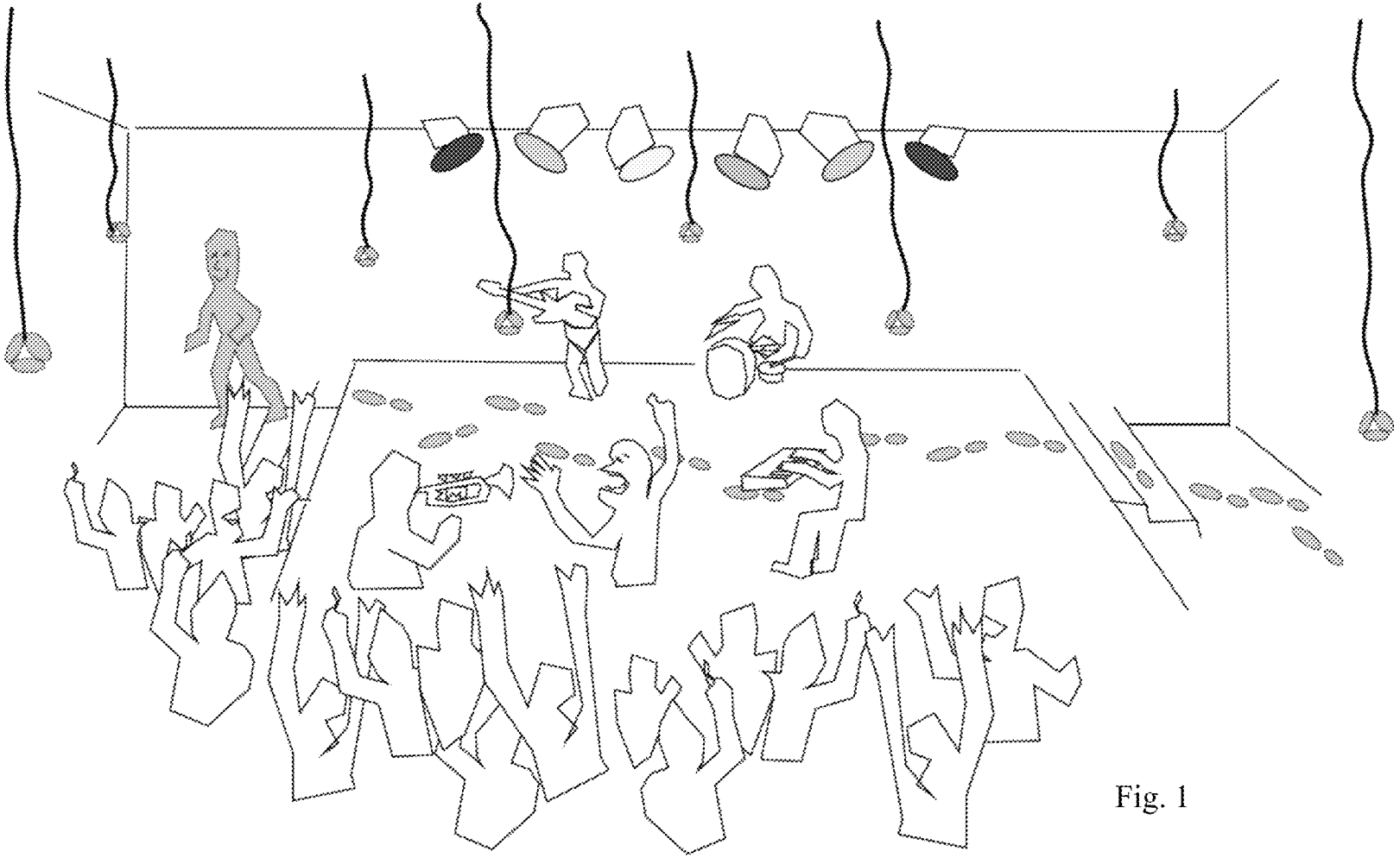
FIG. 1 shows a representative acoustic scene with several virtual listening positions within the acoustic scene.

FIG. 1 shows an acoustic scene (e.g., a concert hall) and the sound of that acoustic scene. There, some people in a crowd are listening to music played by a band. The person near the left corner indicates a certain virtual listening position. Generally, not only in this example, the virtual listening position can be chosen, for example, by a user of a playback apparatus for acoustic scene playback according to the embodiments of the present disclosure. FIG. 1 shows several virtual listening positions within the acoustic scene, which can be chosen arbitrarily by the user of the playback apparatus or by an automated procedure without any manual input by a user of the playback apparatus. For example, FIG. 1 shows virtual listening positions behind the crowd, within the crowd, in front of the crowd, and in front of the stage or next to the musicians on the stage.

Figure 2A:
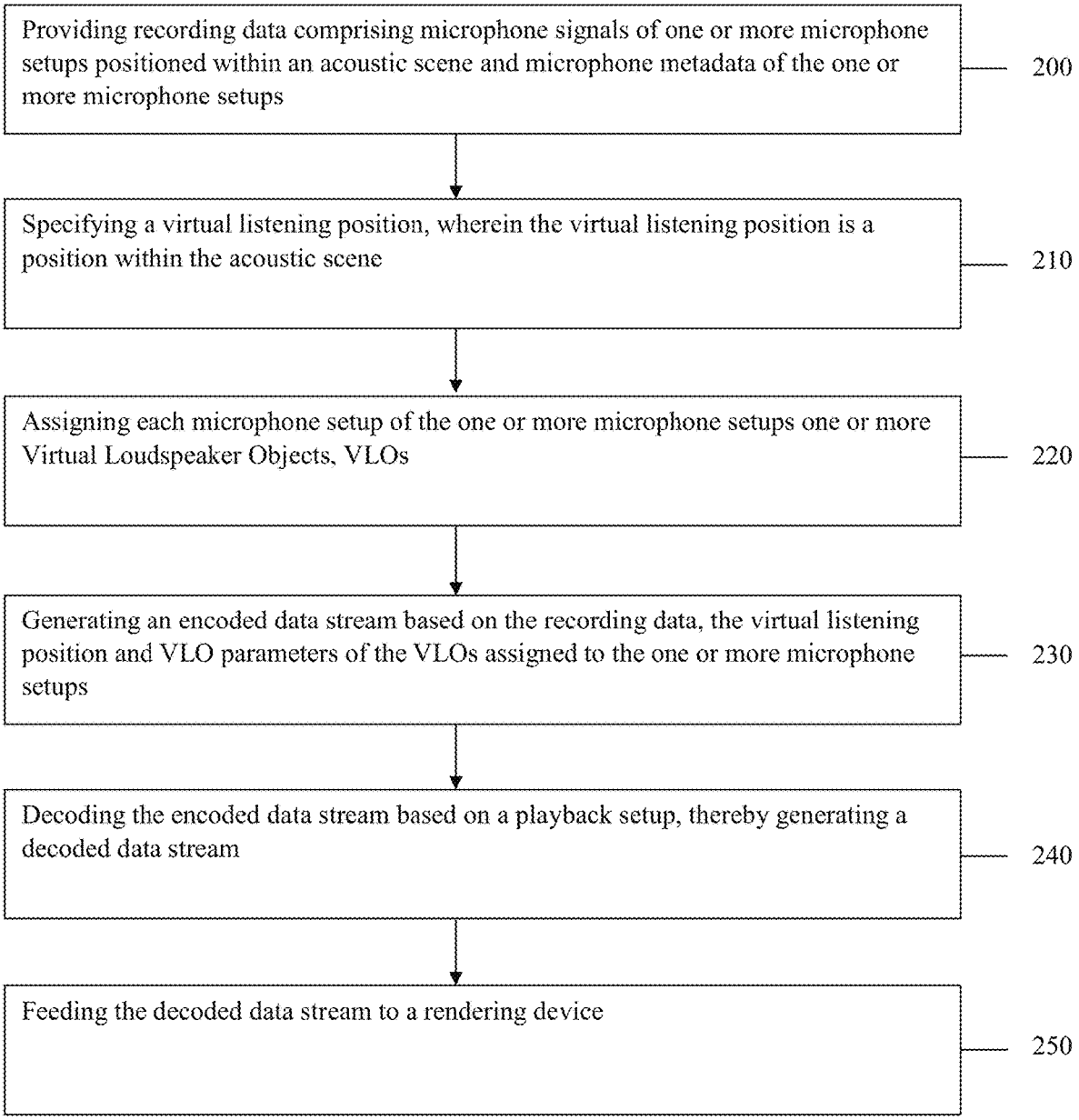
FIG. 2*a* shows a method for acoustic scene playback according to an embodiment of the present disclosure.

FIG. 2*a* shows a method for acoustic scene playback according to an embodiment of the disclosure. In step 200, recording data comprising microphone signals of one or more microphone setups positioned within an acoustic scene and microphone metadata of the one or more microphone setups are provided. Each of the one or more microphone setups comprises one or more microphones. In this context, the microphone metadata can be, for example, microphone positions, microphone orientations and microphone characteristics within the acoustic scene of, for example, FIG. 1. According to step 200 it is only necessary to provide the recording data. The recording data can be computed within any playback apparatus performing the method for acoustic playback or can be received from elsewhere; method step 200 of providing recording data (to the playback apparatus) is a method step that covers both alternatives.

Subsequently, in step 210, the virtual listening position can be specified. The virtual listening position is a position within the acoustic scene. The specifying of the virtual position can, for example, be done by a user using the playback apparatus. For example, the user may be enabled to specify the virtual listening position by typing in a specific virtual listening position into the playback apparatus. However, the specifying the virtual listening position is not restricted to this example and could also be done in an automated manner without manual input of the listener. For example, it is conceivable that the virtual listening positions are read from a CD-ROM or fetched from a storage unit and are therefore not manually determined by any listener.

Furthermore, in a subsequent step 220, each microphone setup of the one or more microphone setups can be assigned one or more virtual loudspeaker objects, VLOs. Each microphone setup comprises (or defines) a recording spot which is a center position of the microphone setup. Each VLO is an abstract sound output object within a virtual free field. The virtual sound field is an abstract sound field consisting of direct sound without reverberant sound. This method step 220 contributes to the advantages of the embodiments of the present disclosure to virtually set up a reproduction system comprising the VLOs for each recording spot in the virtual free field. In the embodiments of the present disclosure the desired effect, i.e. reproducing sound of the acoustic scene at the desired virtual listening position is obtained using virtual loudspeaker objects, VLOs. These VLOs are abstract sound objects that are placed in the virtual free field.

In a step 230, an encoded data stream is generated (e.g., in a playback phase after a recording phase) based on the recording data, the virtual listening position and VLO parameters of the VLOs assigned to the one or more microphone setups. The encoded data stream may be generated by virtually driving, for each of the one or more microphone setups, the one or more VLOs assigned to the respective microphone setup so that these one or more VLOs virtually reproduce the sound that was recorded by the respective microphone setup. The virtual sound at the virtual listening position may then be obtained by superposing (i.e. by forming a linear combination of) the virtual sound from all the VLOs of the method (i.e. from the VLOs of all the microphone setups) at the virtual listening position.

In step 240, the encoded data stream is decoded based on a playback setup, thereby generating a decoded data stream. In this context, the playback setup can be a setup corresponding to a loudspeaker array arranged, for example, in a certain room in a home where the listener wants to listen to sound corresponding to the virtual listening position, or headphones, which the listener wears when listening to the sound of the acoustic scene at the virtual listening position.

Furthermore, this decoded data stream can then, in a step 250, be fed to a rendering device, thereby driving the rendering device to reproduce sound of the acoustic scene at the virtual listening position. The rendering device can be one or more loudspeakers and/or headphones.

Therefore, it is possible to allow a user of a certain playback apparatus to vary a desired virtual listening position for (3D) audio playback within a real, recorded acoustic scene. For example, a user is thus enabled to walk through the entire acoustic scene and listen from any point in the scene. Accordingly, the user can explore the entire acoustic scene in an interactive manner by inputting the desired virtual listening position in a playback apparatus. In the present disclosure, according to the embodiment of FIG. 2*a*, the VLO parameters are adjusted in real-time when the virtual listening position changes. Therefore, the embodiment according to FIG. 2*a* corresponds to a computationally efficient method and allows for both real time encoding and rendering. According to the embodiment of FIG. 2*a*, only the recording data and the virtual listening position need to be provided. The present embodiment of FIG. 2*a* does not rely on prior information about the number or positions of sound sources. Further, all source parameters are inherently encoded and need not be estimated. Contrary to object-based audio approaches, source signals need not be isolated, thus avoiding the need for closed microphones and audible artifacts due to source signal separation.

Figure 2B:
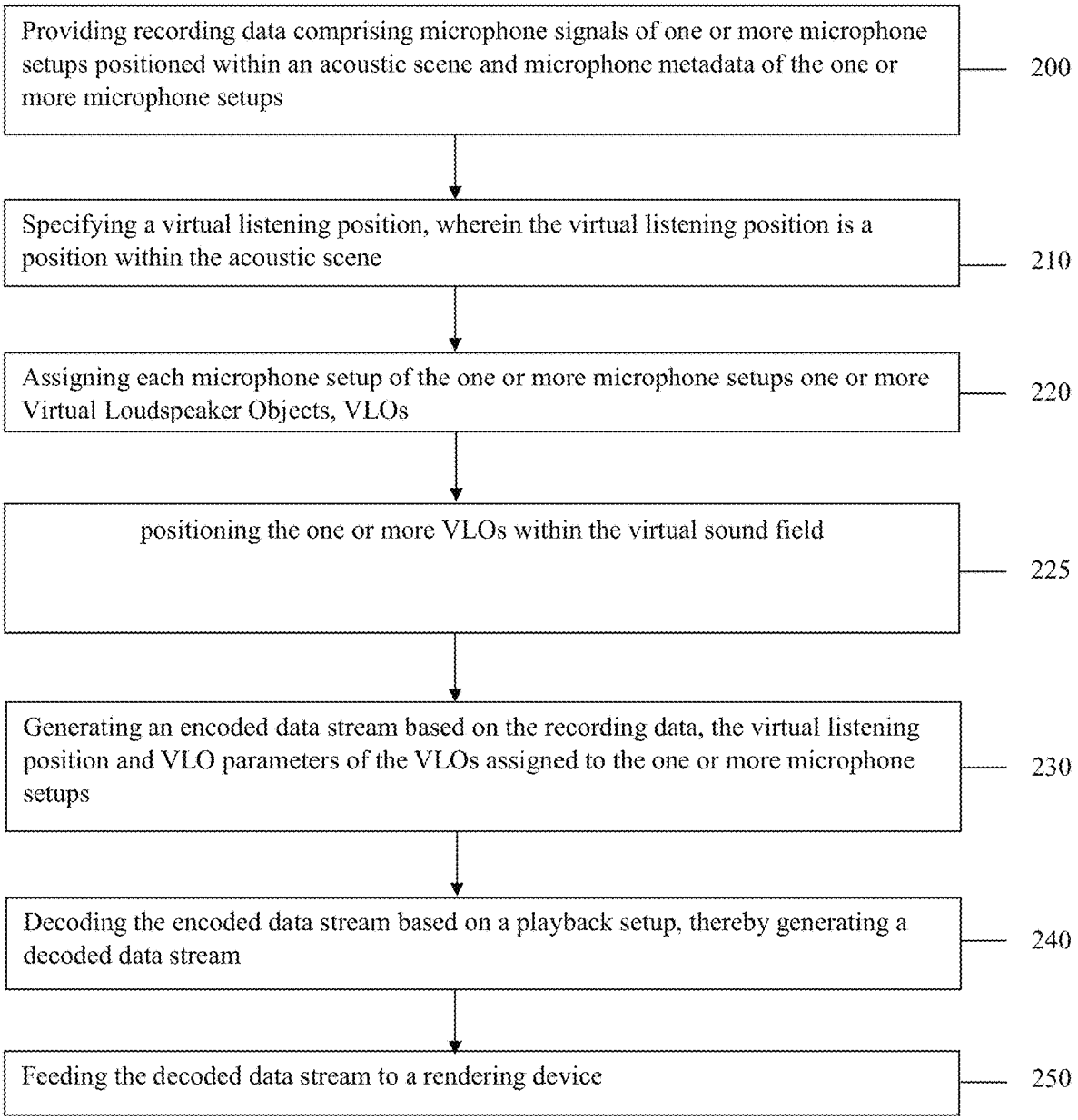
FIG. 2*b* shows a method for acoustic scene playback according to a further embodiment of the present disclosure.
Figure 9:
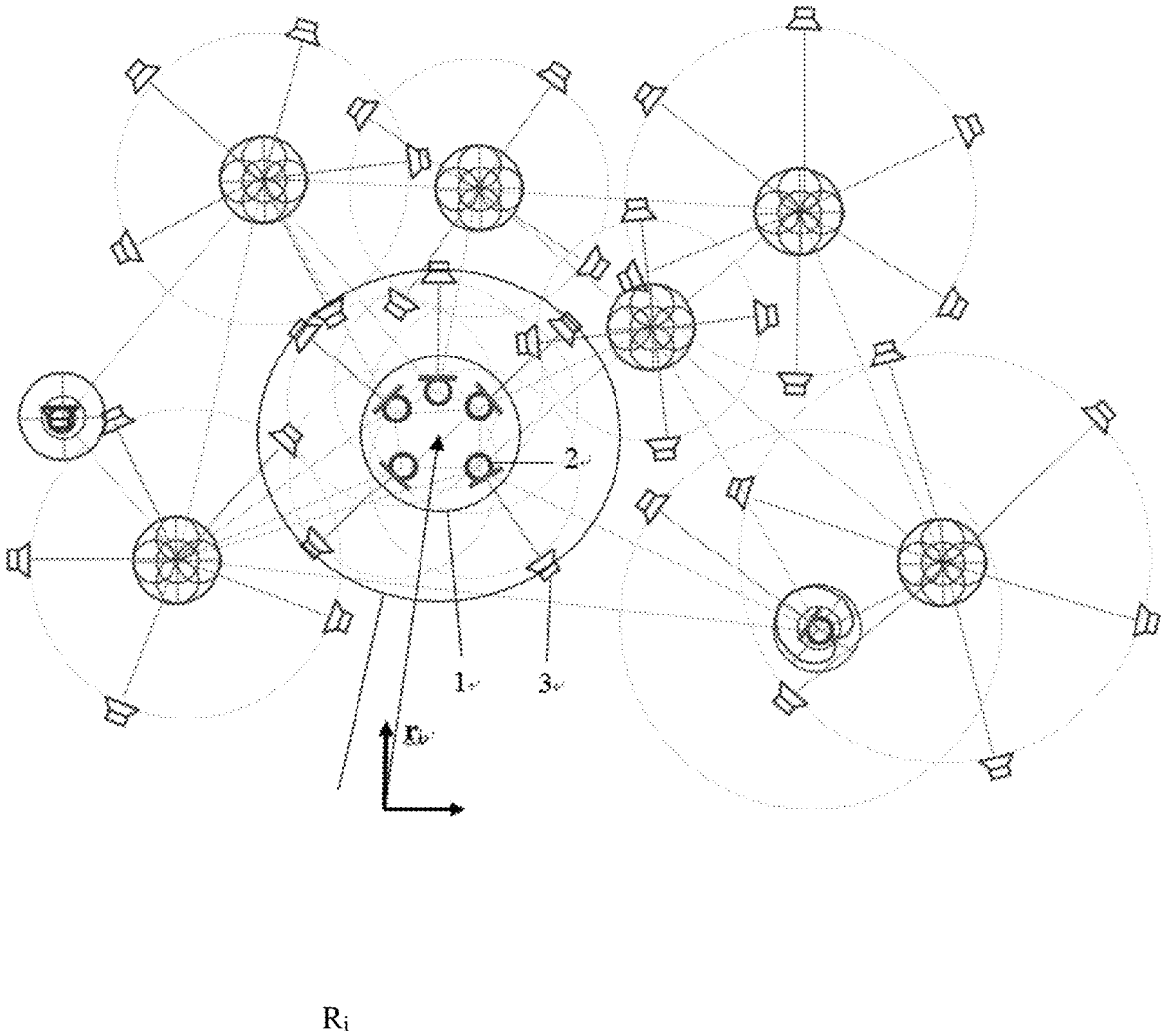
FIG. 9 shows an arrangement and construction of VLOs assigned to corresponding microphone setups according to an embodiment of the present disclosure.

FIG. 2*b* shows a further embodiment of the present disclosure of a method for acoustic scene playback. In comparison to the embodiment of FIG. 2*a* the embodiment of FIG. 2*b* additionally comprises step 225 of positioning, for each microphone setup, the one or more VLOs within the virtual sound field at a position corresponding to the recording spot of the microphone setup within the acoustic scene. For example, the positioning of the VLOs corresponding to each recording spot within the virtual free field can be done as outlined in FIG. 9. In FIG. 9, if not other specified, a group of microphones 2 of an i-th recording spot, which is a center position of the group of microphones 2, can be regarded as one quasi-coincident microphone array as long as the distance between the microphones 2 in the group of microphones is less than, for example, 20 cm. For each (quasi-coincident) microphone array of recording spot i, an average distance to its neighboring (quasi-coincident) microphone arrays can be estimated based on a Delaunay triangulation of the sum of all microphone positions, i.e. all microphone coordinates. For one (quasi-coincident) microphone array with the i-the recording spot an average distance $d_i$ is the median distance to all its neighboring (quasi-coincident) microphone arrays. Further, a playback of the signal of the microphone array at the i-th recording spot is done by VLOs provided on a circle with a radius R around position wherein $r_i$ is a vector from a coordinate origin to the center position of the i-th recording spot. The circle contains $L_i$ virtual loudspeaker objects and its radius $R_i$ can be calculated according to:

$$R_i = c_0 \max(d_i, 3m)$$

Here, $c_0$ is a design parameter that depends on a directivity order of the microphone and on the reverberation of the recording room (in particular the critical distance $r_H$ being the distance at which the sound pressure level of the direct sound and the reverberant sound are equal for a directional source). Therefore, for a microphone directivity order N=0, $c_0$ is 0, and for a microphone directivity order N≥1, for an reverberant room (low $r_H \leq 1$ m) $c_0$ is 0.4, for an "average room" ($r_H \approx 2$ m) $c_0$ is 0.5, and for a dry room ($r_H \geq 3$ m) $c_0$ is 0.6. The number $L_i$ of virtual loudspeakers for the signals of the microphone array at the i-th recording spot, the angular location of the individual virtual loudspeaker objects as well as the virtual loudspeaker directivity control depends on the microphone directivity order $N_i$, on the channel or scene based recording concept of the microphone array, and on the radius $R_i$ of the arrangement of the virtual loudspeakers around the end point of vector $r_i$ and furthermore depends of the distance $d_{ij}$ between the j-th VLO of the i-th recording spot to the virtual listening position.

Further, for a directivity order $N_i$=0 and a single microphone, $L_i$=1 for the i-th recording spot, no virtual loudspeaker directivity control of a virtual acoustic wave directivity is provided (omni-directional pattern). In this case, the virtual loudspeaker object is provided at the recording position of the single microphone.

Furthermore, for the case of having $N_i \geq 1$ one has to decide between two cases, namely a channel-based microphone array and a scene-based microphone array:

For the channel-based microphone array of the order $N_i \geq 1$ with $K_i$ channels (e.g. single-channel cardioid, single-channel shotgun microphone, two-channel XY recording, two-channel ORTF recording, small and frontal and three-channel arrangements), as a default adjustment, each of the $L_i$ VLOs for the i-the recording spot is positioned on-axis with respect to the microphone it is assigned to, using $R_i$ as the distance from the center position of the recording spot i to the corresponding VLO. On-axis means that the VLO corresponding to a microphone of the microphone array is provided on the same line connecting the microphone and the i-the recording spot.

Otherwise, instead of the default adjustment, whenever there is a standard loudspeaker layout for a channel-based microphone array setup, this layout is used for positioning the VLOs on $R_i$ for the i-th recording spot. This can be the case for ORTF with a playback loudspeaker pair dedicated to the two-channel stereo directions ±110°.

For the scene-based microphone arrays of the directivity order $N_i \geq 1$ (e.g. B format) the VLOs are generated according to:

$R_i \leq 2.5$ m: $L_i = 4\ N_i$ with an angular spacing of $90°/N_i$ and a controlled directivity depending on the virtual listening position, wherein the angular spacing indicates the angular spacing of two adjacent VLOs assigned to a same i-the recording spot;

2.5 m$<R_i \leq$3.5 m: $L_i = 5\ N_i$ with an angular spacing of $72°/N_i$ and controlled directivity depending on the virtual listening position;

$R_i >$3.5 m: $L_i = 6\ N_i$ with the angular spacing of $60°/N_i$ and controlled directivity depending on the virtual listening position;

Further, for the scene based microphone arrays (Ambisonic microphone arrays), the arrangement of the VLOs might be potentially overlapping in the virtual free field. To avoid this, each arrangement of VLOs assigned to a corresponding recording spot is rotated with respect to the other arrangements of VLOs in the free virtual field, so that a minimal distance of the neighboring arrangements of VLOs becomes maximal.

In this way, the positions of the VLOs corresponding to the corresponding recording spots can be determined within the virtual free field. As said above, FIG. 9 represents just an example in which, for example, a microphone setup 1 is provided which contains five microphones 2. Furthermore, the corresponding VLOs 3 corresponding to the microphones 2 are also shown together with construction lines supporting the correct determination of the positions of the corresponding VLOs 3.

Furthermore, all other method steps shown in FIG. 2*b* are the same as in FIG. 2*a*.

Figure 2C:
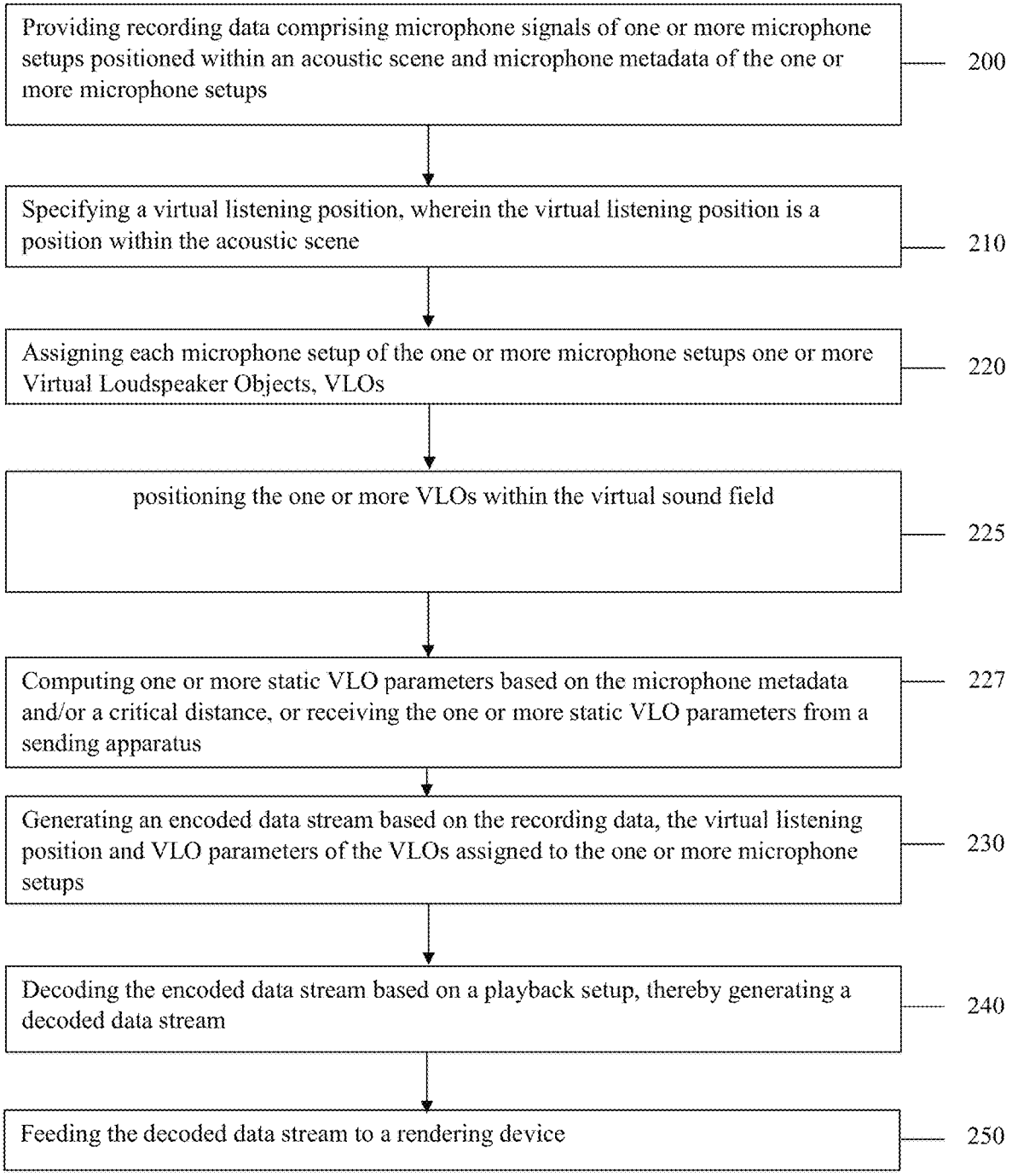
FIG. 2*c* shows a method for acoustic scene playback according to a further embodiment of the present disclosure.

FIG. 2*c* shows another embodiment, which additionally provides method step 227 of computing the one or more static VLO parameters based on the microphone metadata and/or a critical distance being a distance at which a sound pressure level of the direct sound and the reverberant sound are equal for a directional source, or receiving the one or more static VLO parameters from a transmission apparatus. In this context, it is noted that in principle method step 227 could also be provided before performing any of the steps 200, 210, 220 and 225 or between two of these method steps 200, 210, 220 or 225. Therefore, the position of step 227 in FIG. 2*c* is just an example position. In this context, static VLO parameters do not depend on any desired virtual listening position and are only determined once for a specific recording setup and acoustic scene playback and are not changed for an acoustic scene playback. In this context, the recording setup refers to all the microphone positions, microphone orientations, microphone characteristics and other characteristics of the scene where the acoustic scene is recorded. For example, the static VLO parameters can be a number of VLOs per recording spot, the distance of the VLOs to the assigned recording spot, the angular layout of the VLOs, and a mixing matrix $B_i$ for the i-the recording spot. The term angular layout can refer to an angle between a line connecting the recording spot and a VLO assigned to the recording spot and a line starting from the microphone and pointing in the main pick-up direction of the microphone. However, the term angular layout can also refer to an angular spacing between neighboring VLOs assigned to a same recording spot. These static VLO parameters depend on the microphone positions, microphone characteristics, microphone orientations and an estimated or assumed critical distance. In a room the critical distance is the distance to a sound source at which its direct sound equals the reverberant sound of the room. At smaller distances the direct sound is louder. At greater distances the reverberant sound is louder.

Figure 2D:
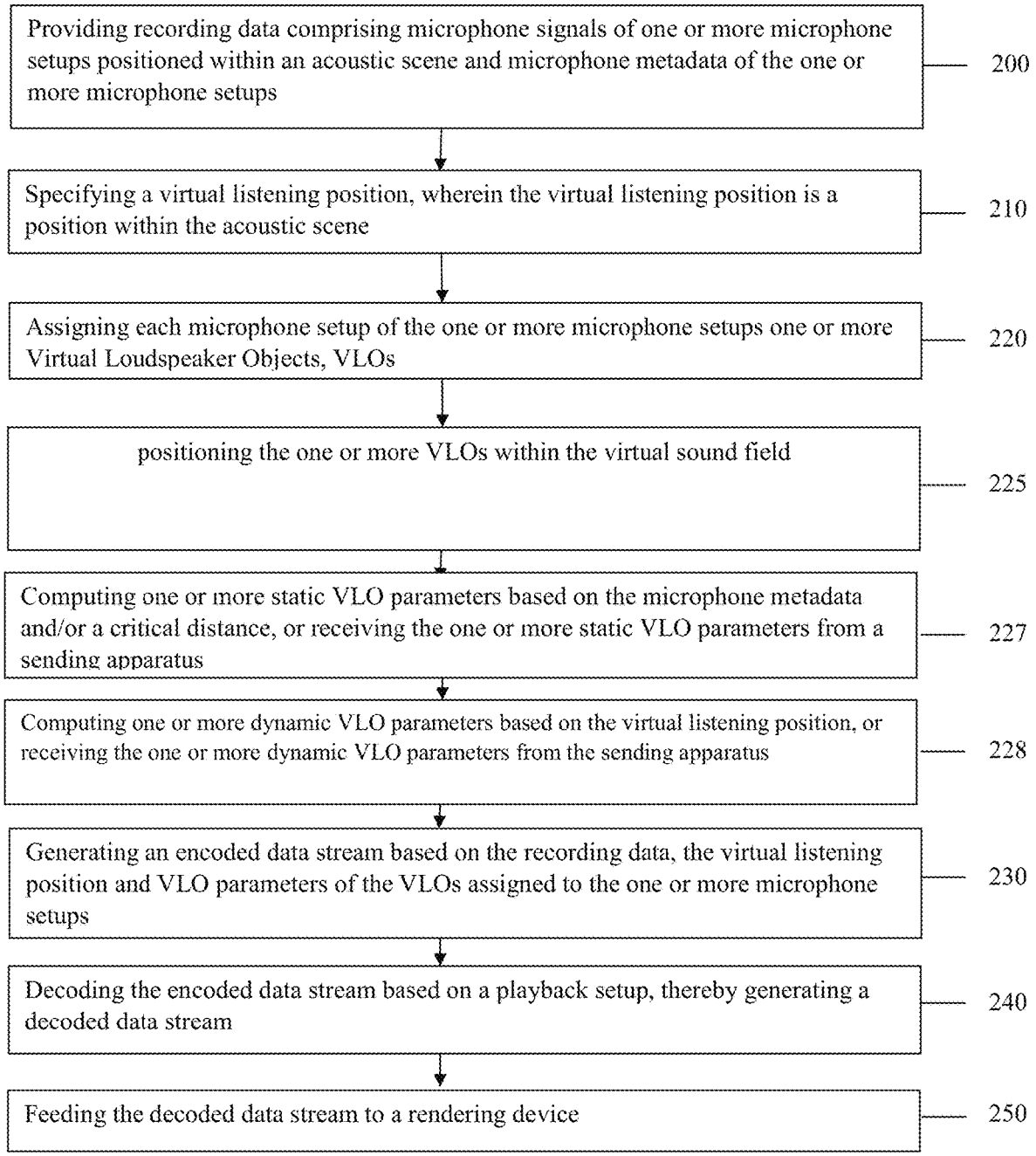
FIG. 2*d* shows a method for acoustic scene playback according to a further embodiment of the present disclosure.
Figure 11:
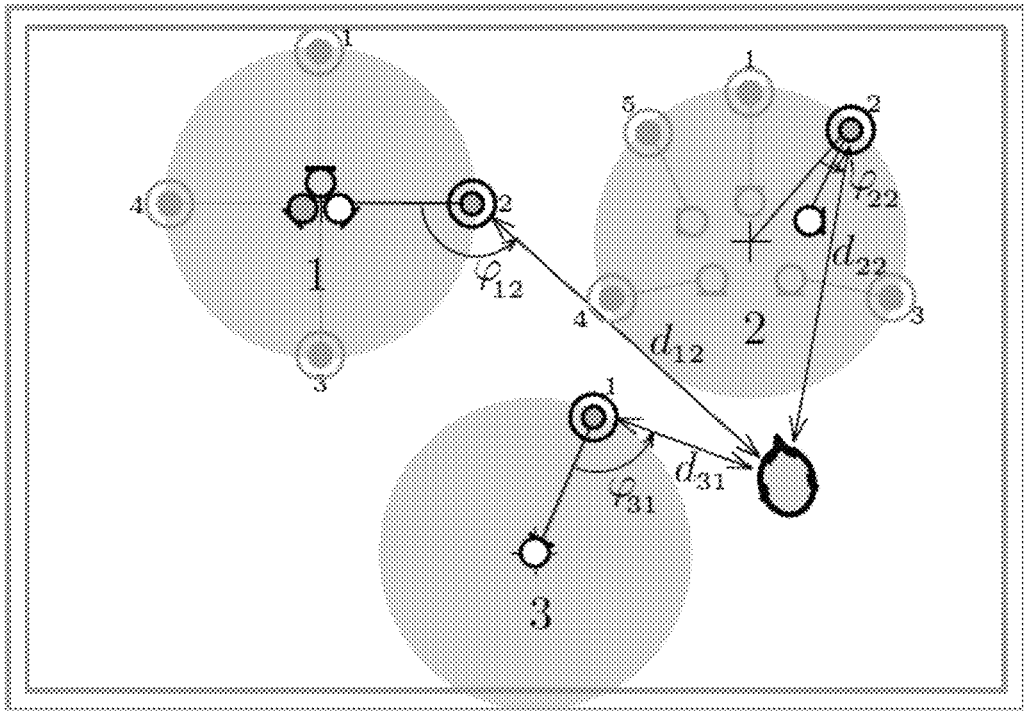
FIG. 11 shows a relation between VLOs and a virtual listening position in the virtual free field according to an embodiment of the present disclosure.
Figure 12A:
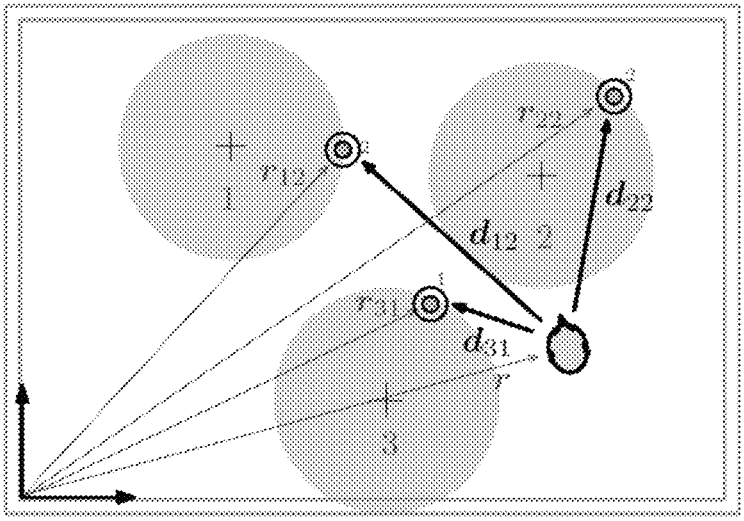
FIG. 12*a* shows another relation between VLOs and a virtual listening position in the virtual free field according to a another embodiment of the present disclosure.
Figure 12B:
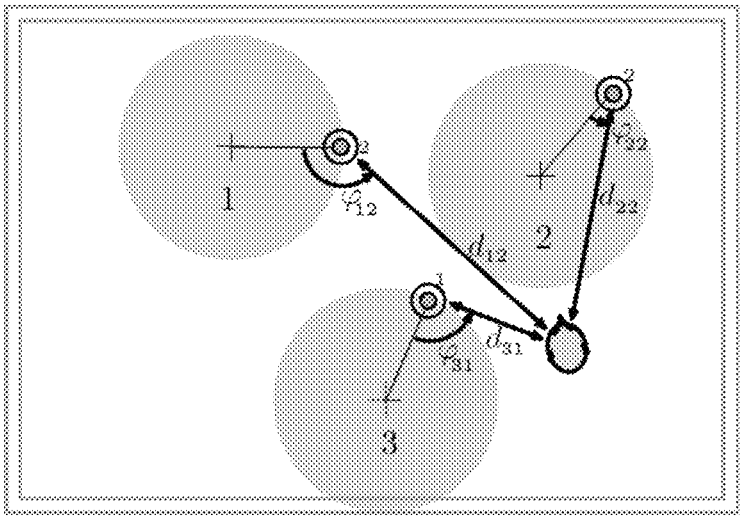
FIG. 12*b* shows another relation between VLOs and a virtual listening position in the virtual free field according to a another embodiment of the present disclosure.

FIG. 2*d* shows a further embodiment of the present disclosure. In comparison to the embodiment of FIG. 2C, FIG. 2*d* additionally refers to method step 228 of computing one or more dynamic VLO parameters based on the virtual listening position, or receiving the one or more dynamic VLO parameters from a transmission apparatus. In this context, it is noted that step 228 is disclosed in FIG. 2*d* after step 227 and before step 230, however, the position of step 228 within the method flow diagram of FIG. 2*d* is just an example and, in principle, step 228 could be shifted within FIG. 2*d* at any position as long as this method step is performed before generating the encoded data stream and after the virtual listening position was specified. Therefore, method step 228 refers to two possibilities, namely computing the dynamic VLO parameters within the playback apparatus or alternatively receiving the dynamic VLO parameters from outside, for example, from the transmission apparatus. In this context, the dynamic parameters depend on the desired virtual listening position and are re-computed whenever the virtual listening position changes. Examples for dynamic VLO parameters are the VLO gains, wherein each VLO gain is a gain of a control signal of a corresponding VLO, VLO directivities being the directivity of the virtual acoustic wave radiated by the corresponding VLO, the VLO delays, wherein each VLO delay is a time delay of an acoustic wave propagating from the corresponding VLO to the virtual listening position and VLO incident angles, wherein each VLO incident angle is an angle between a line connecting the recording spot and the corresponding VLO and a line connecting the corresponding VLO and the virtual listening position. For example, as can be seen in FIG. 11, FIG. 11 or FIG. 12*b* provide a schematic view, wherein incident angles $\varphi_{12}$, $\varphi_{22}$ and $\varphi_{31}$ are indicated, wherein these angles $\varphi_{ij}$ are the incident angles and each incident angle is an angle between a line connecting the corresponding i-th recording spot and the corresponding j-th VLO and a line connecting the corresponding j-th VLO and the virtual listening position. Furthermore, FIG. 11 also shows distances $d_{ij}$, namely distances $d_{12}$, $d_{22}$ and $d_{31}$ indicating a distance between the corresponding j-th VLO of the corresponding i-th recording spot to the virtual listening position. Therefore, as can be seen in FIG. 12*a* the distance vector $d_{ij}$ can be calculated as $d_{ij}=r_{ij}-r$, wherein r is the vector connecting the position of the virtual listening position and the origin of a coordinate system as can be seen in FIG. 12*a* and the vector $r_{ij}$ is the vector indicating the position of the corresponding j-th VLO of the i-th recording spot within the coordinate system. Furthermore, the VLO delay $\tau_{ij}$ indicating the time the virtual acoustic wave needs to travel from the j-the VLO of the i-the recording spot can be defined as $\tau_{ij}=d_{ij}/c$, wherein c is the velocity of an acoustic wave. Furthermore, the VLO gain $g_{ij}$ can be calculated as: $g_{ij}=f(\varphi_{ij}, d_{ij})/d_{ij}$. In this context, the function $f(\varphi_{ij}, d_{ij})$ is a function, which provides a proximity regularization due to the dependency on $d_{ij}$ and a direction dependency due to the dependency on $\varphi_{ij}$.

Figure 13:
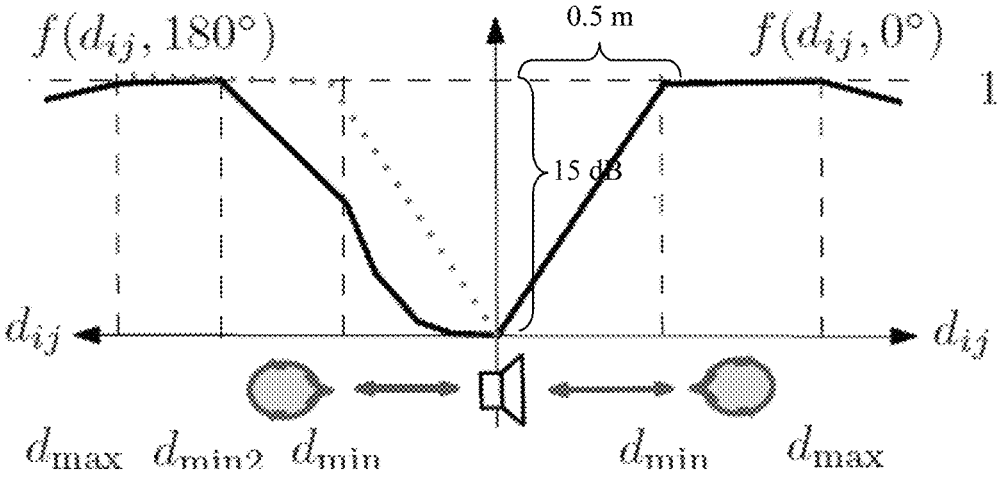
FIG. 13 shows a relation between a function f indicating a gain for a corresponding VLO dependent on the distance of the VLO to the virtual listening position according to an embodiment of the present disclosure.

In this context, the function $f(\varphi_{ij}, d_{ij})$ is exemplarily shown in FIG. 13, which shows on the y axis $f(d_{ij}, 180°)$ for one VLO and the x axis indicates the distance $d_{ij}$ from the VLO. Therefore, as one can clearly see from the above definition of the gain $g_{ij}$ a classical free field $1/d_{ij}$ attenuation of the corresponding virtual loudspeaker object is implemented and due to the function $f(\varphi_{ij}, d_{ij})$ an additional distance-dependent attenuation is provided, which avoids unrealistically loud signals whenever the virtual listening position is in close proximity of the virtual loudspeaker object. This can be seen in FIG. 13 indicating such an additional distance-dependent attenuation. As can be seen in FIG. 13, for example, if the distance dij from the virtual listening position to the corresponding VLO is ≥0.5 m, then a classical free field 1/r attenuation is provided. However, if the distance $d_{ij}=0$, then an attenuation by, for example, 15 dB is provided. Furthermore, as can also be clearly seen in FIG. 13, a linear interpolation is provided in $0<d_{ij}<0.5$ m. Furthermore, $f(\varphi_{ij}, d_{ij})$ can therefore be calculated according to:

$$f(\varphi_{ij}, d_{ij}) = \min\left(\frac{d_{ij}}{d_{min}}, 1\right)[\alpha + (1-\alpha)\cos\varphi_{ij}]$$

wherein $$\alpha = \frac{1}{2} - \frac{1}{2}\min\left(\frac{d_{ij}}{d_{min2}}, 1\right),$$

wherein $d_{min}$ indicates the start of the linear interpolation towards $d_{ij}=0$ for $\varphi_{ij}=0°$, and $d_{min2}$ indicates a limit of the linear interpolation, which is provided in the interval from $d_{min2}$ to $d_{min}$ for $\varphi_{ij}=180°$ as indicated in FIG. 13 with $d_{min2}$.

There, the first term $$\min\left(\frac{d_{ij}}{d_{min}}, 1\right)$$

indicates the distance regularization and the second term $\alpha+(1-\alpha)\cos\varphi_{ij}$ indicates the direction dependency of the virtual acoustic waves radiated by the corresponding VLO.

Figure 10:
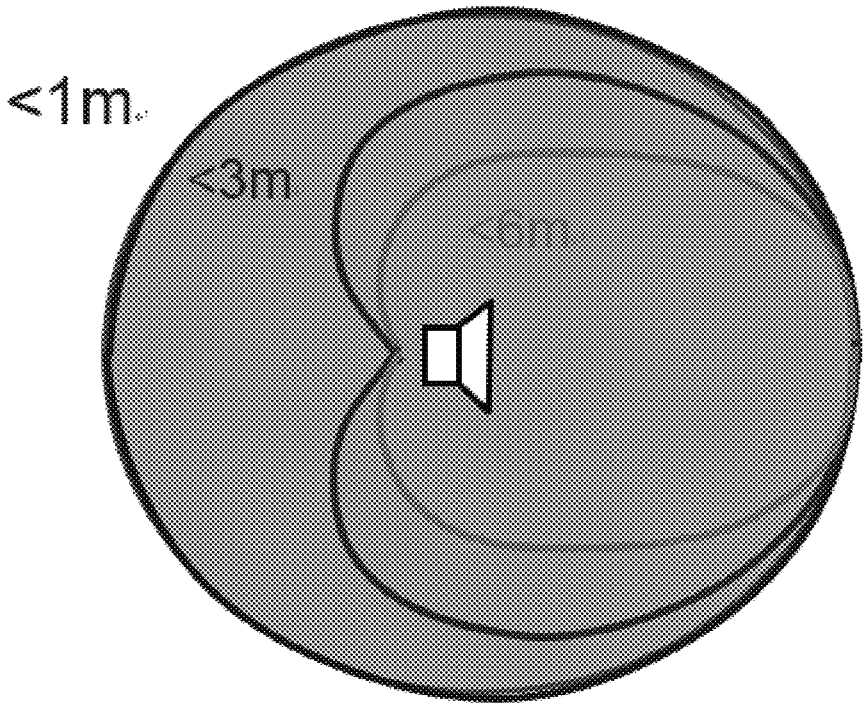
FIG. 10 shows directivity patterns of a VLO according to an embodiment of the present disclosure.

The radiation characteristics of each VLO can be adjusted, so that the interactive directivity (depending on the virtual listening position) distinguishes between "inside" and "outside" within an arrangement of VLOs corresponding to a corresponding microphone setup in a way that a signal amplitude for the dominant "outside" is reduced in order to avoid dislocation at the diffuse end far field. Furthermore, the directivity is formulated in a mix of omni-directional and figure-of-eight directivity patterns with controllable order $$\alpha + [1-\alpha]\left(\frac{1+\cos(\theta)}{2}\right)^{\beta},$$

wherein $\alpha$ and $\beta$ indicate parameters with which the direction dependency of a virtual acoustic wave radiated by the corresponding VLO is calculated. There, $\alpha$ determines the weight of the omni-directional radiation and $\beta$ determines the weight of the figure-of-eight directivity pattern of the above-mentioned expression. Furthermore, also directivity patterns in the shape of hemispheric slepian functions are also conceivable. Furthermore, in particular, for a large distance dij between the virtual loudspeaker object and the virtual listening position, a backwards amplitude of each VLO can be lowered by controlling $\alpha$. An implementation example would be that the backwards amplitude for the corresponding VLO for $d_{ij}\leq 1$ m is $\alpha=1$ and the backwards amplitude of VLO for $d_{ij}\geq 3$ m is $\alpha=0$, wherein in between a linear interpolation is provided. Furthermore, the exponent $\beta$ controls the selectivity between inside and outside at great distances $d_{ij}$ between the virtual listening position and the j-the VLO of the i-the recording spot, such that the localization mismatch or unnecessary diffuse appearance of distant acoustic sources are minimized. An implementation example would be that the distance $d_{ij}\leq 3$ m, so that $\beta=1$ and when the distance $d_{ij}$ is $\geq 6$ m, then $\beta=2$, wherein a linear interpolation is provided in between. In this way, the recording positions are getting suppressed that cannot be part of a common acoustic convex hull of a distant or diffuse audio scene due to their orientation. In this context, FIG. 10 shows the cardioid diagram of one virtual loudspeaker object. There, the omnidirectional directivity pattern is shown with a circle for dij>1 m, and further directivity patterns being generated by a superposition of the omnidirectional and the figure-of-eight directivity patterns for $d_{ij}<3$ m and $d_{ij}<6$ m.

Furthermore, all other steps in the embodiment according to FIG. 2*d* are the same as in the previous embodiment according to FIG. 2*c*.

Figure 2E:
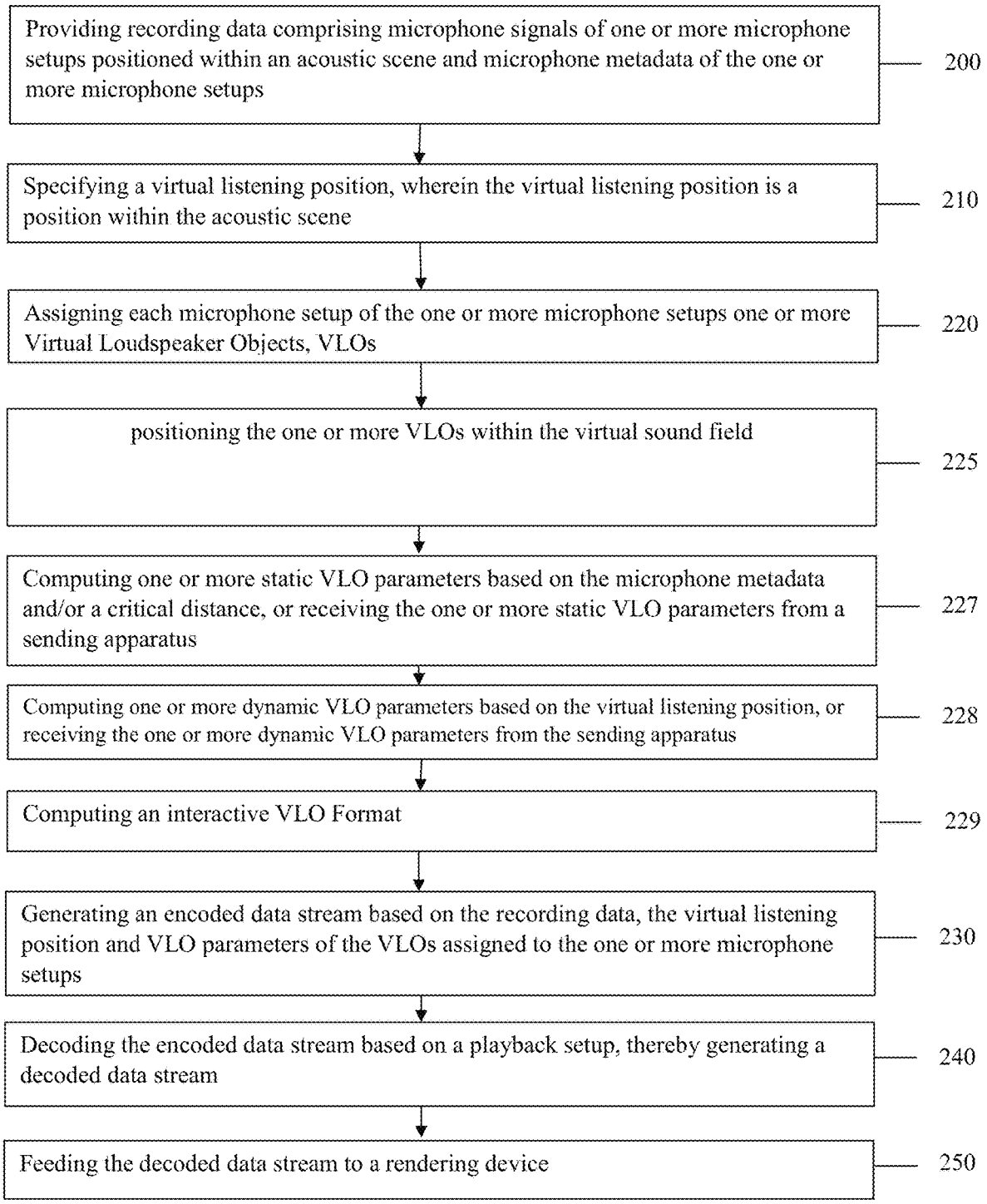
FIG. 2*e* shows a method for acoustic scene playback according to a further embodiment of the present disclosure.

FIG. 2*e* shows another embodiment, wherein in comparison to the embodiment shown in FIG. 2*d* the embodiment in FIG. 2*e* additionally claims method step 229 of computing an interactive VLO format comprising, for each recording spot and for each VLO assigned to the recording spot a resulting signal $\tilde{x}_{ij}(t)$ and an incident angle $\varphi_{ij}$ with $\tilde{x}_{ij}(t)=g_{ij}x_{ij}(t-\tau_{ij})$, wherein $g_{ij}$ is a gain factor of a control signal $x_{ij}$ of a j-th VLO of the i-th recording spot, $\tau_{ij}$ is a time delay of an acoustic wave propagating from the j-th VLO of the i-th recording spot to the virtual listening position and t indicates time, wherein the incident angle $\varphi_{ij}$ is an angle between a line connecting the i-th recording spot and the j-th VLO of the i-th recording spot and a line connecting the j-th VLO of the i-th recording spot and the virtual listening position.

Figure 7:
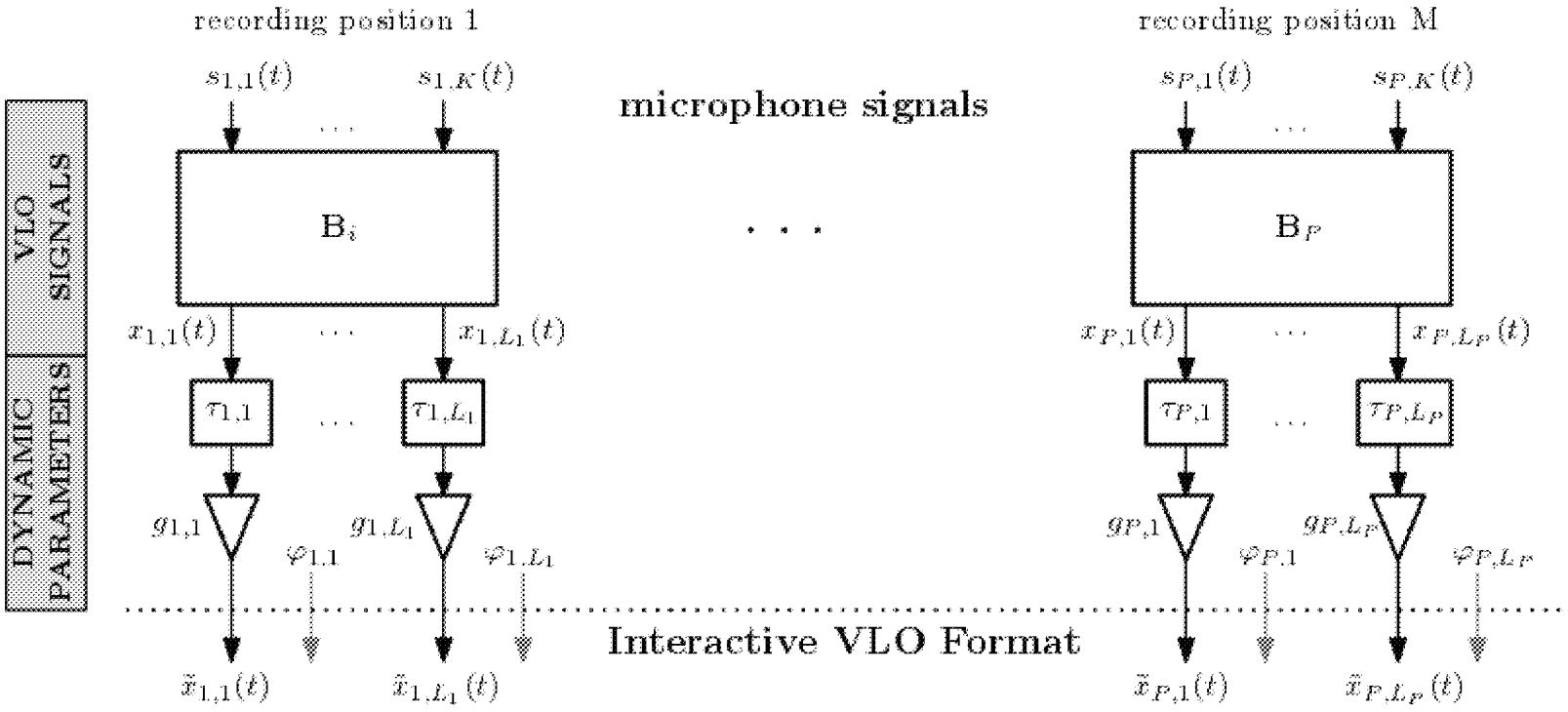
FIG. 7 shows a block diagram for computing an interactive VLO format from microphone signal according to an embodiment of the present disclosure.

An example for performing method step 229, i.e. generating the interactive VLO format, can also be seen in FIG. 7 showing a block diagram for computing the interactive VLO format from microphone signals. For each of P recording spots in the acoustic scene, i.e. recording positions, the control signals of the corresponding VLOs are obtained from its assigned microphone (array) signals. The control signals for the i-th recording spot are obtained as:

$$x_i(t)=B_i s_i(t),$$

where $x_i(t)=[x_{i1}(t), x_{i2}(t), \ldots, x_{iL_i}(t)]^T$ is a control signal vector (VLO signal vector) (of dimension $L_i\times 1$, i.e. a column vector of length $L_i$) of all VLOs assigned to the i-the recording spot, $s_i(t)=[s_{i1}(t), s_{i2}(t), \ldots, s_{iK_i}(t)]^T$ is the microphone signal vector (of dimension $K_i\times 1$) and $B_i$ is the $L_i\times K_i$ mixing matrix, where $L_i$ is the number of VLOs and $K_i$ is the number of microphones, and t is the time.

This can also be clearly seen in FIG. 7 showing as input to the mixing matrix $B_i$ the corresponding microphone signals. For each VLO, the VLO format stores one resulting signal $\tilde{x}_{ij}(t)$ and the corresponding incident angle $\varphi_{ij}$.

In FIG. 7, the overall block diagram for computing the interactive VLO format is presented based on the corresponding microphone signals, wherein in this example it is assumed that a total of P recording positions, i.e. P microphone spots, are given. The above mentioned resulting signal is correspondingly schematically drawn in FIG. 7.

Figure 3:
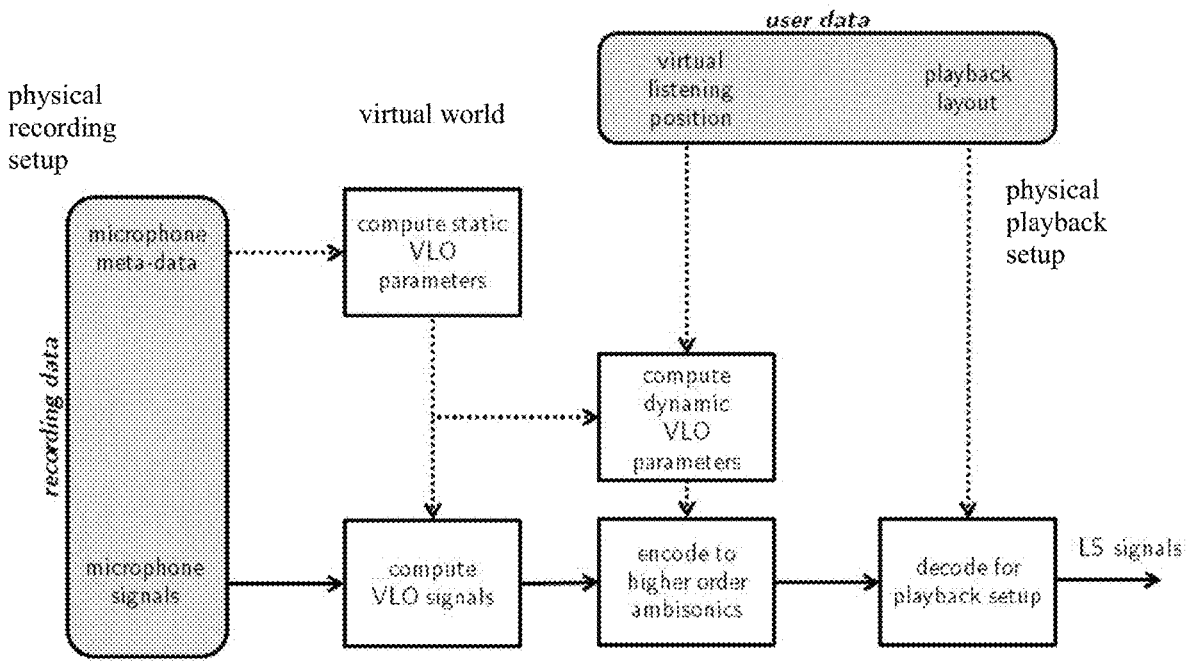
FIG. 3 shows a block diagram of a method for acoustic scene playback according to an embodiment of the present disclosure.

FIG. 3 shows an overall block diagram of the method for acoustic scene playback according to an embodiment of the present disclosure. There, on the left side the recording data are provided, wherein the recording data comprise microphone signals and microphone metadata. In this context, the present disclosure is not restricted to any recording hardware, e.g. specific microphone arrays. The only requirement is that microphones are distributed within the acoustic scene to be captured and the positions, characteristics (omni-directional cardioid, etc.) and orientations are known. However, the best results are obtained if distributed microphone arrays are used. These arrays may be (first or higher order) spherical microphone arrays or any compact classical stereophonic or surrounding recording setups (e.g. XY, ORFT, MS, OCT surround, Fukada Tree). Furthermore, as can be seen in FIG. 3, the microphone metadata serve for computing the static VLO parameters. Furthermore, the microphone signals and the static VLO parameters can be used for computing the control signals for controlling each of the VLOs in the virtual free field, namely the VLO signals, wherein each control signal serves for controlling a corresponding VLO within the virtual free field. Furthermore, as can be seen in FIG. 3 the dynamic VLO parameters can be calculated based on the chosen virtual listening position and based on the static VLO parameters. Furthermore, the dynamic VLO parameters and the control signals are used as input for the encoding, preferably a higher order ambisonic encoding. The resulting encoded data stream is then decoded as a function of a certain playback setup. An example of a certain playback setup can be a setup corresponding to an arrangement of loudspeakers in a room or the playback setup can reflect the usage of headphones. Depending on such a playback setup the corresponding decoding is performed, as can also be seen in FIG. 3. The resulting decoded data stream is then fed to a rendering device, which can be loudspeakers or headphones as can also be seen in FIG. 8.

The block diagram of FIG. 3 can be performed by a playback apparatus. In this context it is to be mentioned that in principle the method steps shown in FIG. 3 of providing the recording data, computing the static VLO parameters, computing the control signals, namely the VLO signals, can be done at a place outside the playback apparatus, for example, at a location remote from the playback apparatus, but can also be performed within the playback apparatus. Since the virtual listening position has to be provided to the playback apparatus, the only thing which has to be preferably performed within the playback apparatus is the computing of the dynamic VLO parameters together with the encoding and the decoding step. However, all other method steps shown in FIG. 3 do not need to be performed within the playback apparatus, but could also be performed outside of the playback apparatus. Therefore, for example, the recording data can be provided in any conceivable manner to the playback apparatus, namely, for example, by receiving the recording data via an internet connection using live streaming or similar things. A further alternative is generating the recording data within the playback apparatus itself of fetching the recording data from a recording medium provided within the playback apparatus. Further, the block diagram of FIG. 3 just shows an example and the method steps of FIG. 3 have not to be performed in the way depicted in FIG. 3.

Figure 4:
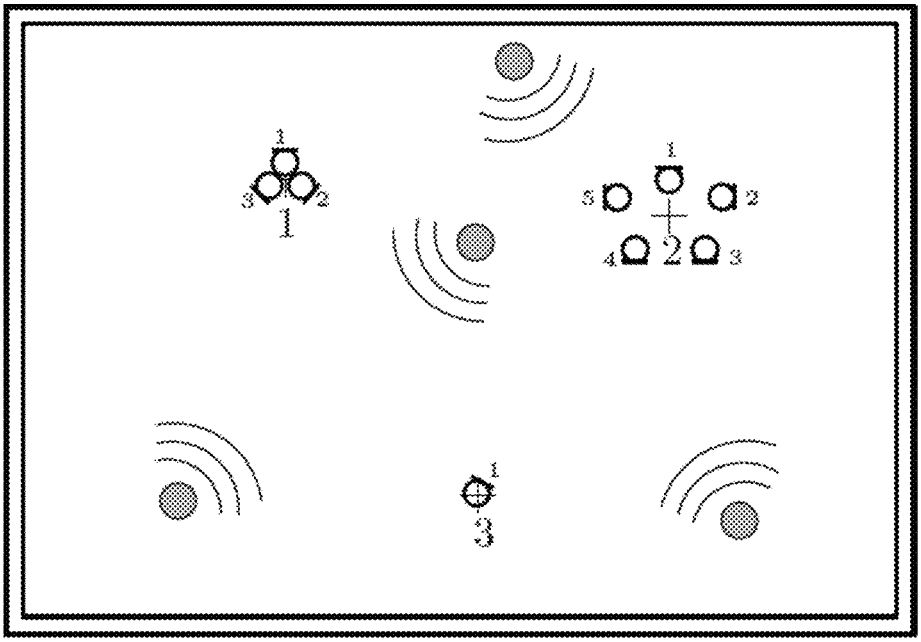
FIG. 4 shows an exemplary microphone and source distribution within an acoustic scene.

FIG. 4 shows an example of microphone and source distributions in an acoustic scene, wherein the acoustic scene is recorded with three distributed compact microphone setups. Setup 1 is a 2D B-format microphone, setup 2 is a standard surround setup and setup 3 is a single directional microphone.

Figure 5:
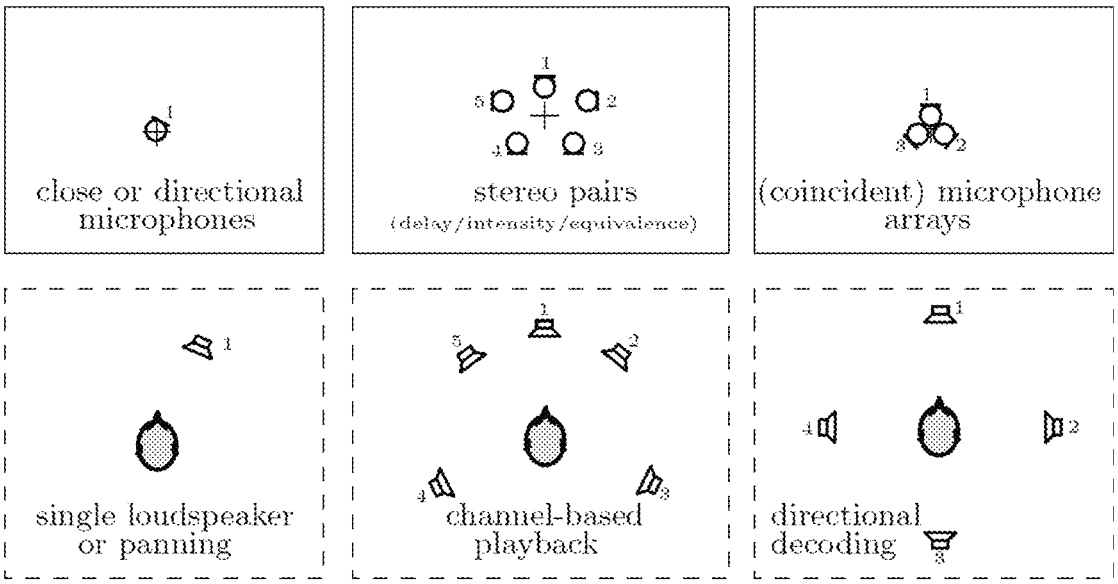
FIG. 5 shows an exemplary reproduction setups for different microphone setups.

FIG. 5 shows each of the three microphone setups 1, 2 and 3 (see the upper row in FIG. 5) along with a corresponding loudspeaker setup (see the lower row of FIG. 5) that could be used to reproduce the acoustic scene (sound field) captured by the respective microphone setup. That is, each of these loudspeaker setups containing one or more virtual loudspeakers, VLOs, would accurately reproduce the spatial sound field at the center position, i.e. recording spot, of the corresponding microphone setup associated with the respective loudspeaker setup. Therefore, the present disclosure aims at virtually setting up a reproduction system in the virtual free field including loudspeaker setups for each microphone setup. The VLOs assigned to a corresponding microphone setup are positioned within the corresponding virtual free field at positions corresponding to the position of the corresponding microphone setup.

Figure 6:
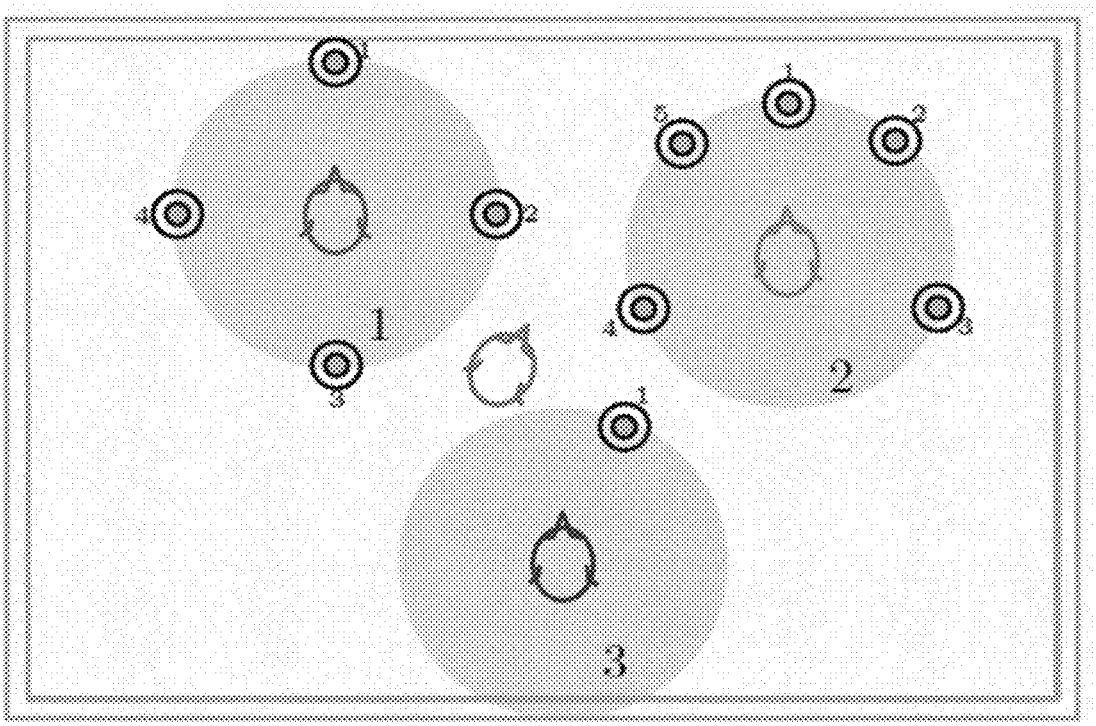
FIG. 6 shows VLOs and corresponding virtual listening positions in a virtual free field.

FIG. 6 illustrates a possible setup of VLOs within the virtual free field. If a virtual listening position approximately coincides with one of the center positions of the microphone setups, i.e. the recording spots, and given that the control signals for all VLOs corresponding to the other recording spots are sufficiently attenuated, it is obvious that the spatial image conveyed to the listener is accurate when the VLOs are encoded and rendered accordingly. In this context it is noted that for these virtual listening positions only the angular layout of the VLOs is important, while the radii (shown as gray circles in FIG. 6) of the reproduction systems are not crucial. In FIG. 6 the arrangement of the VLOs corresponding the microphone setups 1, 2, 3 as shown in FIG. 4 are shown. If, however, the virtual listening position does not coincide with a recording spot, the spatial image of the acoustic scene is likely to be corrupted and the listener will likely dislocate the acoustic sources. Furthermore, mixing time-shifted correlated signals may produce phasing artefacts. Therefore, in the embodiments of the present disclosure, these difficulties are overcome by an automatic parametrization of the VLOs (e.g. VLO positions, gains, directivities, etc.) to minimize dislocation and to convey a plausible spatial image to the listener for arbitrary listening positions, while avoiding phasing artefacts.

In the case that the virtual listening position is at the center position of the recording spot (recording position) signals of a virtual loudspeaker object join free of disturbing interference: typical acoustical delays are between 10-50 ms. Together with distance-related attenuation, a mix of hereby audio technically uncorrelated signals will not yield to any disturbing timbral interferences. Furthermore, a precedence effect supports proper localization at all recording positions. Furthermore, in case of a few virtual loudspeaker objects per playback spot in the free virtual field, the multitude of other playback spots supports localization and room impression.

However, for the case that the virtual listening position is off the center position of any recording spot, potential localization confusion can be avoided by adjusting position, gain and delay of corresponding virtual loudspeaker objects depending on the virtual listening position. Furthermore, interferences are reduced by choosing suitable distances between the virtual loudspeakers, which controls phase and delay properties to ensure high sound quality. The arrangement and therefore positions of the VLOs assigned to a corresponding recording spot can be automatically generated from the metadata of the microphone setups. This yields to an arrangement of VLOs whose superimposed playback is controllable so as to achieve the following properties for arbitrary virtual listening positions: Perceived interference (phase) is minimized by optimally considering the phenomena of the auditory precedence effect. In particular, the localization dominance can be exploited by selecting suitable distances between the virtual loudspeaker objects with respect to each other. In doing so, the acoustic propagation delays are adjusted so as to reach excellent sound quality. Furthermore, the angular distance of the virtual loudspeaker objects with respect to each other is chosen so as to yield the largest achievable stability of the phantom source, which will then depend on the order of the gradient microphone directivities associated with the virtual loudspeaker object, the critical distance of the room reverberations, and the degree of coverage of the recorded acoustic scene by the microphones.

Figure 8:
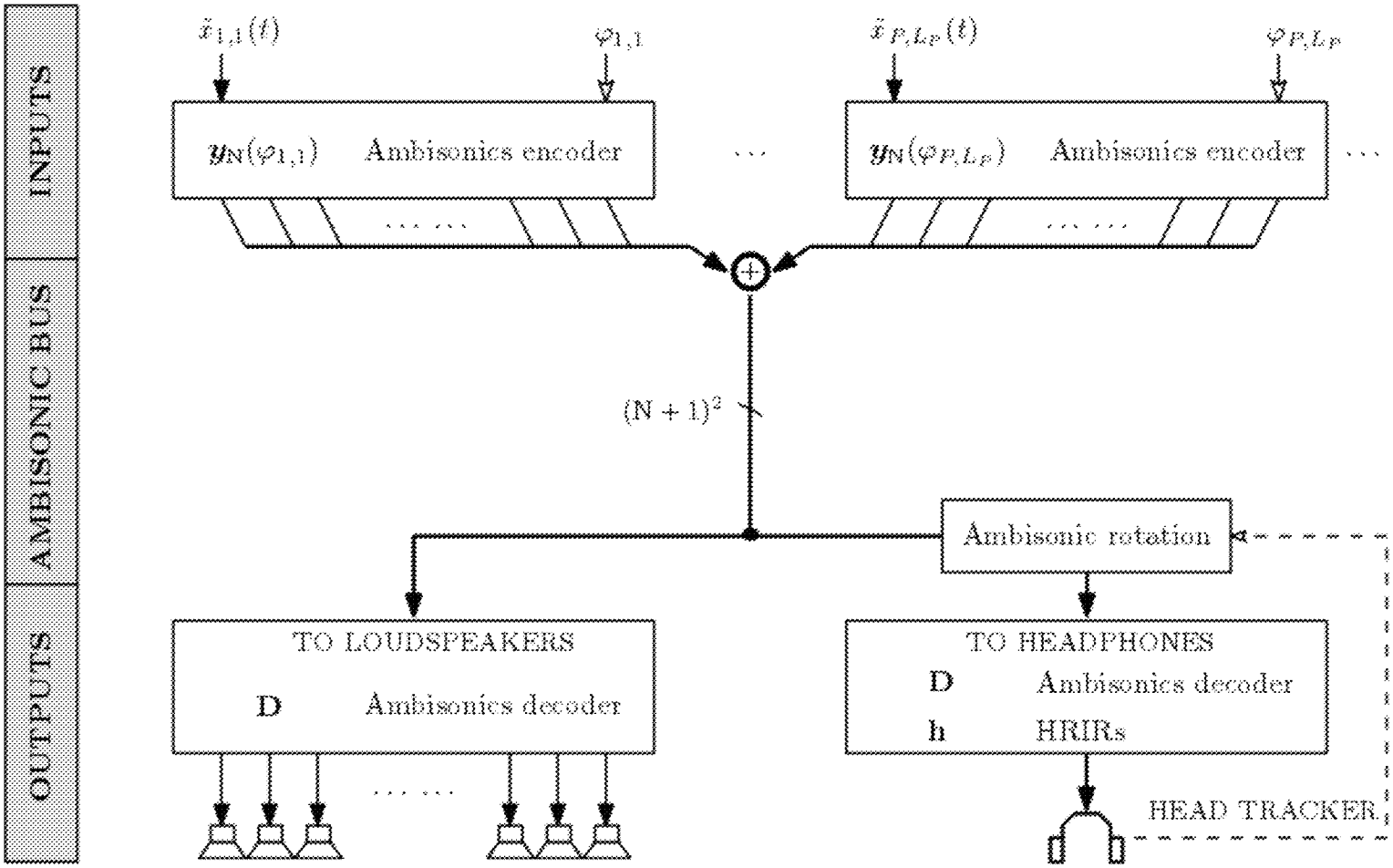
FIG. 8 shows a block diagram of encoding/decoding of the interactive VLO format according to an embodiment of the present disclosure.

FIG. 8 shows an order N HOA encoding/decoding of the VLO format. Since each VLO is defined by its corresponding resulting signal and incident angle, any reproduction system that is able to render sound objects can be used (e.g. wave field synthesis, binaural encoding). However, in the embodiments of the present disclosure the higher order ambisonics (HOA) format can be used for maximal flexibility concerning the reproduction system. Firstly, the interactive VLO format is encoded to the HOA signals, which can be rendered either for a specific loud speak arrangement or binaural headphone reproduction. The block diagram for HOA encoding and decoding is shown in FIG. 8, wherein as input to the corresponding encoder the corresponding resulting signal and incident angle are fed. After performing the encoding the encoded data streams are summed and fed to corresponding ambisonic decoders provided within loudspeakers or headphones via an ambisonic bus. Optionally, a head tracker can be provided for adequately performing an ambisonic rotation as can be seen in FIG. 8.

In FIG. 8, using the VLO parameters (static and dynamic VLO parameters), the virtual sound field generated by the VLOs within the virtual free field is encoded to higher-order ambisonics (HOA). That is, the signals are fed on the ambisonic bus of ambisonic signals of order N:

$$\chi_N(t) = \sum_{i=1}^{P} \sum_{j=1}^{L_i} y_N(\varphi_{ij}) \tilde{x}_{ij}(t),$$

where $y_N$ are circular or spherical harmonics evaluated at the VLO incident angles $\varphi_{ij}$ corresponding to the current virtual listener position. Further, $L_i$ refers to the number of VLOs for the i-th microphone recording spot and P indicates the total number of microphone setups within the acoustic scene. The recommended order of encoding is larger than 3, typically order 5 gives stable results.

Furthermore, with respect to the decoding, the decoding of scene-based material uses headphone or loudspeaker-based HOA decoding methods. In general, the most flexible and therefore the most favored decoding method to loudspeakers or in the case of headphone playback to a set of head-related impulse responses (HRIRs) is called ALLRAD. Other methods can be used, such as decoding by sampling, energy preservation, or regularized mode matching. All these methods yield similar performance on directionally well-distributed loudspeaker or HRIR layouts. Decoders typically use a frequency-independent matrix to obtain the signals for the loudspeakers of known setup directions or for being convoluted with a given set of HRIRs:

$$y(t)=D\chi_N(t)$$

On headphone-based playback, the directional signals y(t) are convolved with the right and the left HRIRs of the corresponding directions and then summed up per ear:

$$u_{left}(t) = \sum_i h_{i,left}(t) * y_i(t)$$

$$u_{right}(t) = \sum_i h_{i,right}(t) * y_i(t)$$

To achieve the representation of a static virtual audio scene, head rotation β measured by head tracking has to be compensated for in headphone-based playback. In order to keep the set of HRIR static, this is preferably done by modifying the Ambisonic signal with a rotation matrix before decoding to the HRIR set $$\chi'_N(t)=R(-\beta)\chi_N(t)$$

The playback apparatus, which is configured to perform the methods for acoustic scene playback, can comprise a processor and a storage medium, wherein the processor is configured to perform any of the method steps and the storage medium is configured to store microphone signals and/or metadata of one or more microphone setups, the static and/or dynamic VLO parameters and/or any information necessary for performing the methods of the embodiments of the present disclosure. The storage medium can also store a computer program containing program code for performing the methods of the embodiments and the processor is configured to read the program code and perform the method steps of the embodiments of the present disclosure according to the program code. In a further embodiment, the playback apparatus can also comprise units, which are configured to perform the method steps of the disclosed embodiments, wherein for each method step a corresponding unit can be provided dedicated to perform the assigned method steps. Alternatively, a certain unit within the playback apparatus can be configured to perform more than one method step disclosed in the embodiments of the present disclosure.

The disclosure has been described in conjunction with various embodiments herein. However, other variations to the enclosed embodiments can be understood and effected by those skilled in the art and practicing the claimed disclosure, from a study of the drawings, the disclosure and the appended claims. In these claims, the word "comprising" does not exclude other elements or steps and the indefinite article "a" or "an" does not exclude a plurality. A single processor or another unit may fulfill the function of several items recited in the claims. The mere effect that certain measures are recited in mutually different dependent claims does not indicate that a combination of these features cannot be used to advantage. A computer program may be stored/distributed on a suitable medium, such as an optical storage medium or a solid state medium supplied together with or as part of the other hardware, but may also be distributed in other forms, such as via the internet or other wired or wireless telecommunication systems.

What is claimed is:

1. A method for acoustic scene playback, the method comprising:

providing recording data comprising microphone signals of one or more microphone setups positioned within an acoustic scene and microphone metadata of the one or more microphone setups, wherein each of the one or more microphone setups comprises one or more microphones and has a recording spot which is a center position of the respective microphone setup;

receiving user input specifying a virtual listening position, wherein the virtual listening position is a position within the acoustic scene;

assigning each microphone setup, of the one or more microphone setups, one or more Virtual Loudspeaker Objects (VLOs), wherein each VLO is an abstract sound output object within a virtual free field, wherein the virtual free field is a virtual sound field that consists of direct sound without reverberant sound;

for each microphone setup, positioning the one or more VLOs within the virtual sound field at a position corresponding to the recording spot of the respective microphone setup within the acoustic scene;

generating an encoded data stream based on the recording data, the virtual listening position and VLO parameters of the VLOs assigned to the one or more microphone setups;

decoding the encoded data stream based on a playback setup, thereby generating a decoded data stream; and feeding the decoded data stream to a rendering device, thereby driving the rendering device to reproduce sound of the acoustic scene at the virtual listening position specified by the user input, wherein for each of the one or more microphone setups, the one or more VLOs assigned to the respective microphone setup are provided on a circular line having the recording spot of the respective microphone setup as a center of the circular line within the virtual free field, and a radius Ri of the circular line depends on a directivity order of the microphone setup, a reverberation of the acoustic scene and an average distance di between the recording spot of the respective microphone setup and recording spots of neighboring microphone setups.

2. The method according to claim 1, wherein the VLO parameters comprise one or more static VLO parameters which are independent of the virtual listening position and describe properties, which are fixed for the acoustic scene playback, of the one or more VLOs.

3. The method according to claim 2, further comprising, before generating the encoded data stream, performing one of computing the one or more static VLO parameters based on the microphone metadata and/or a critical distance, wherein the critical distance is a distance at which a sound pressure level of the direct sound and a sound pressure level of the reverberant sound are equal for a directional source; and receiving the one or more static VLO parameters from a transmission apparatus.

4. The method according to claim 1, wherein one or more static VLO parameters include for each of the one or more microphone setups at least one of:

a number of VLOs, a distance of each VLO to the recording spot of the respective microphone setup, an angular layout of the one or more VLOs that have been assigned to the respective microphone setup with respect to an orientation of the one or more microphones of the respective microphone setup, and a mixing matrix which defines a mixing of the microphone signals of the respective microphone setup.

5. The method according to claim 1, wherein the VLO parameters comprise one or more dynamic VLO parameters which depend on the virtual listening position and wherein the method comprises, before generating the encoded stream one of:

computing the one or more dynamic VLO parameters based on the virtual listening position, and receiving the one or more dynamic VLO parameters from a transmission apparatus.

6. The method according to claim 5, wherein the one or more dynamic VLO parameters include for each of the one or more microphone setups at least one of:

one or more VLO gains, wherein each of the one or more VLO gain is a gain of a control signal of a corresponding VLO, one or more VLO delays, wherein each VLO delay is a time delay of an acoustic wave propagating from the corresponding VLO to the virtual listening position, one or more VLO incident angles, wherein each VLO incident angle is an angle between a line connecting the recording spot and the corresponding VLO and a line connecting the corresponding VLO and the virtual listening position, and one or more parameters indicating a radiation directivity of the corresponding VLO.

7. The method according to claim 1, further comprising, before generating the encoded data stream, computing an interactive VLO Format comprising for each recording spot and for each VLO assigned to the recording spot a resulting signal $\tilde{x}_{ij}(t)$ and an incident angle $\varphi_{ij}$ with $\tilde{x}_{ij}(t)=g_{ij}x_{ij}(t-\tau_{ij})$, wherein $g_{ij}$ is a gain factor of a control signal $x_{ij}$ of a j-th VLO of a i-th recording spot, $\tau_{ij}$ is a time delay of an acoustic wave propagating from the j-th VLO of the i-th recording spot to the virtual listening position, and t indicates time, wherein the incident angle $\varphi_{ij}$ is an angle between a line connecting the i-th recording spot and the j-th VLO of the i-th recording spot and a line connecting the j-th VLO of the i-th recording spot and the virtual listening position.

8. The method according to claim 7, wherein the gain factor $g_{ij}$ depends on the incident angle $\varphi_{ij}$ and a distance dij between the j-th VLO of the i-th recording spot and the virtual listening position.

9. The method according to claim 8, wherein for generating the encoded data stream each resulting signal and incident angle is input to an encoder.

10. The method according to claim 9, wherein at least one of a number of VLOs on the circular line, an angular location of each VLOs on the circular line, and a directivity of the acoustic radiation of each VLO on the circular line depends on at least one of a microphone directivity order of the respective microphone setup, a recording concept of the respective microphone setup, the radius Ri of the recording spot of the i-th microphone setup and a distance dij between a j-th VLO of the i-th microphone setup and the virtual listening position.

11. The method according to claim 1, wherein for providing the recording data, at least one of the recording data are received from outside; and the recording data are fetched from a recording medium.

12. A playback apparatus configured to perform a method comprising:

providing recording data comprising microphone signals of one or more microphone setups positioned within an acoustic scene and microphone metadata of the one or more microphone setups, wherein each of the one or more microphone setups comprises one or more microphones and has a recording spot which is a center position of the respective microphone setup;

receiving user input specifying a virtual listening position, wherein the virtual listening position is a position within the acoustic scene;

assigning each microphone setup of the one or more microphone setups one or more Virtual Loudspeaker Objects (VLOs) wherein each VLO is an abstract sound output object within a virtual free field, wherein the virtual free field is a virtual sound field that consists of direct sound without reverberant sound;

for each microphone setup, positioning the one or more VLOs within the virtual sound field at a position corresponding to the recording spot of the respective microphone setup within the acoustic scene;

generating an encoded data stream based on the recording data, the virtual listening position and VLO parameters of the VLOs assigned to the one or more microphone setups;

decoding the encoded data stream based on a playback setup, thereby generating a decoded data stream; and feeding the decoded data stream to a rendering device, thereby driving the rendering device to reproduce sound of the acoustic scene at the virtual listening position specified by the user input, wherein for each of the one or more microphone setups, the one or more VLOs assigned to the respective microphone setup are provided on a circular line having the recording spot of the respective microphone setup as a center of the circular line within the virtual free field, and a radius Ri of the circular line depends on a directivity order of the microphone setup, a reverberation of the acoustic scene and an average distance di between the recording spot of the respective microphone setup and recording spots of neighboring microphone setups.

13. A computer program on a non-transitory storage medium, for instructing a playback apparatus to perform a method comprising:

providing recording data comprising microphone signals of one or more microphone setups positioned within an acoustic scene and microphone metadata of the one or more microphone setups, wherein each of the one or more microphone setups comprises one or more microphones and has a recording spot which is a center position of the respective microphone setup;

receiving user input specifying a virtual listening position, wherein the virtual listening position is a position within the acoustic scene;

assigning each microphone setup of the one or more microphone setups one or more Virtual Loudspeaker Objects (VLOs) wherein each VLO is an abstract sound output object within a virtual free field, wherein the virtual free field is a virtual sound field that consists of direct sound without reverberant sound;

for each microphone setup, positioning the one or more VLOs within the virtual sound field at a position corresponding to the recording spot of the respective microphone setup within the acoustic scene;

generating an encoded data stream based on the recording data, the virtual listening position and VLO parameters of the VLOs assigned to the one or more microphone setups;

decoding the encoded data stream based on a playback setup, thereby generating a decoded data stream; and feeding the decoded data stream to a rendering device, thereby driving the rendering device to reproduce sound of the acoustic scene at the virtual listening position specified by the user input, wherein for each of the one or more microphone setups, the one or more VLOs assigned to the respective microphone setup are provided on a circular line having the recording spot of the respective microphone setup as a center of the circular line within the virtual free field, and a radius Ri of the circular line depends on a directivity order of the microphone setup, a reverberation of the acoustic scene and an average distance di between the recording spot of the respective microphone setup and recording spots of neighboring microphone setups.

* * * * *